US008962230B2

(12) United States Patent
Seitoku

(10) Patent No.: US 8,962,230 B2
(45) Date of Patent: Feb. 24, 2015

(54) ELECTROSTATIC-IMAGE DEVELOPING TONER, ELECTROSTATIC IMAGE DEVELOPER, TONER CARTRIDGE, PROCESS CARTRIDGE, IMAGE-FORMING APPARATUS, AND METHOD FOR FORMING IMAGE

(71) Applicant: Fuji Xerox Co., Ltd., Tokyo (JP)

(72) Inventor: Shigeru Seitoku, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/894,785

(22) Filed: May 15, 2013

(65) Prior Publication Data

US 2014/0106275 A1 Apr. 17, 2014

(30) Foreign Application Priority Data

Oct. 11, 2012 (JP) ..... 2012-226419

(51) Int. Cl.

| | |
|---|---|
| ***G03G 9/087*** | (2006.01) |
| ***G03G 9/113*** | (2006.01) |
| ***G03G 13/22*** | (2006.01) |
| ***G03G 15/08*** | (2006.01) |
| ***G03G 21/18*** | (2006.01) |
| ***G03G 9/08*** | (2006.01) |

(52) U.S. Cl.

CPC ..... *G03G 9/1135* (2013.01); *G03G 13/22* (2013.01); *G03G 15/0865* (2013.01); *G03G 21/18* (2013.01); *G03G 15/08* (2013.01); *G03G 9/0819* (2013.01); *G03G 9/0827* (2013.01); *G03G 9/08759* (2013.01); *G03G 9/08791* (2013.01); *G03G 9/08793* (2013.01); *G03G 9/08795* (2013.01); *G03G 9/08797* (2013.01)

USPC ..... 430/109.4; 430/110.1; 430/110.3; 430/110.4; 430/123.5

(58) Field of Classification Search

USPC ..... 430/109.4, 110.1, 110.3, 110.4, 123.5

See application file for complete search history.

(56) References Cited

U.S. PATENT DOCUMENTS

| | | | | |
|---|---|---|---|---|
| 2010/0196817 | A1* | 8/2010 | Sasaki et al. | 430/109.4 |
| 2012/0183896 | A1* | 7/2012 | Sacripante et al. | 430/108.4 |
| 2013/0022907 | A1 | 1/2013 | Fukagawa et al. | |

FOREIGN PATENT DOCUMENTS

| | | |
|---|---|---|
| JP | A-2002-284732 | 10/2002 |
| JP | A-2012-107175 | 6/2012 |

* cited by examiner

*Primary Examiner* — Peter Vajda

(74) *Attorney, Agent, or Firm* — Oliff PLC

(57) ABSTRACT

An electrostatic-image developing toner contains an amorphous polyester resin that has repeating units having a backbone derived from dehydroabietic acid in a main chain thereof and that has a weight average molecular weight of about 30,000 to about 80,000; and at least one of a crystalline polyester resin containing a dicarboxylic acid (C10) and a diol (C9) as polymerization components and a crystalline polyester resin containing a dicarboxylic acid (C9) and a diol (C10) as polymerization components.

18 Claims, 2 Drawing Sheets

ELECTROSTATIC-IMAGE DEVELOPING TONER, ELECTROSTATIC IMAGE DEVELOPER, TONER CARTRIDGE, PROCESS CARTRIDGE, IMAGE-FORMING APPARATUS, AND METHOD FOR FORMING IMAGE

CROSS-REFERENCE TO RELATED APPLICATIONS

This application is based on and claims priority under 35 USC 119 from Japanese Patent Application No. 2012-226419 filed Oct. 11, 2012.

BACKGROUND (i) Technical Field

The present invention relates to electrostatic-image developing toners, electrostatic image developers, toner cartridges, process cartridges, image-forming apparatuses, and methods for forming images.

(ii) Related Art

Electrophotographic image-forming apparatuses form an image by fixing an unfixed toner image formed on a recording medium using a fixing device. There are known fixing devices that fix an unfixed toner image formed on a recording medium by heating and pressing the toner image using a fixing member (such as a belt or roller).

There are known toners containing a polyester resin for use in electrophotographic image formation. To reduce environmental impact, research has been directed toward the use of plant-derived materials as materials for polyester resins, at least partially, instead of petroleum-derived materials.

One typical plant-derived material is rosin, which is extracted from pine resin. Rosin is a mixture of various terpene carboxylic acids. There are known techniques for using such carboxylic acids for polymeric materials.

SUMMARY

According to an aspect of the invention, there is provided an electrostatic-image developing toner containing an amorphous polyester resin that has repeating units having a backbone derived from dehydroabietic acid in a main chain thereof and that has a weight average molecular weight of about 30,000 to about 80,000; and at least one of a crystalline polyester resin containing a dicarboxylic acid (C10) and a diol (C9) as polymerization components and a crystalline polyester resin containing a dicarboxylic acid (C9) and a diol (C10) as polymerization components. The dicarboxylic acid (C10) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 10. The dicarboxylic acid (C9) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 9. The diol (C10) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 10. The diol (C9) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 9.

BRIEF DESCRIPTION OF THE DRAWINGS

Exemplary embodiments of the present invention will be described in detail based on the following figures, wherein.

DETAILED DESCRIPTION

Figure 1:
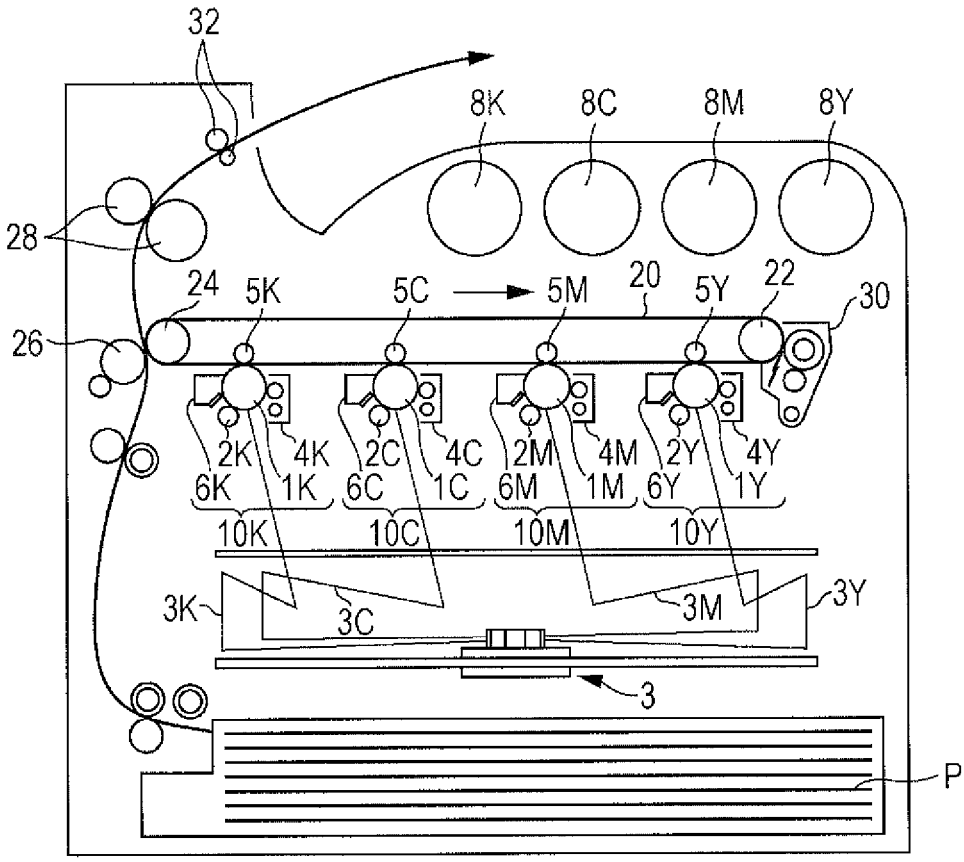
FIG. 1 is a schematic view of an example of an image-forming apparatus according to an exemplary embodiment.

Electrostatic-image developing toners, electrostatic image developers, toner cartridges, process cartridges, image-forming apparatuses, and methods for forming images according to exemplary embodiments of the present invention will now be described in detail.

As used herein, the term "offset" refers to a phenomenon in which toner is transferred from a toner image to a fixing member (such as a belt or roller) in electrophotographic image formation.

The term "cold offset (low-temperature offset)" refers to an offset of toner from a toner image due to insufficient heating.

The term "hot offset (high-temperature offset)" refers to an offset of toner from a toner image due to overheating.

Electrostatic-Image Developing Toner

An electrostatic-image developing toner (hereinafter also referred to as "toner") according to an exemplary embodiment contains an amorphous polyester resin that has repeating units having a backbone derived from dehydroabietic acid in a main chain thereof and that has a weight average molecular weight of 30,000 to 80,000 or about 30,000 to about 80,000 (hereinafter also referred to as "particular amorphous polyester resin"); and at least one of a crystalline polyester resin containing a dicarboxylic acid (C10) and a diol (C9) as polymerization components and a crystalline polyester resin containing a dicarboxylic acid (C9) and a diol (C10) as polymerization components (hereinafter also referred to as "particular crystalline polyester resin").

The dicarboxylic acid (C10) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 10.

The dicarboxylic acid (C9) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 9.

The diol (C10) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 10.

The diol (C9) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 9.

Thus, the use of the toner according to this exemplary embodiment to form an image may provide a fixed image with high image strength after fixing at relatively low temperatures.

Additionally, the use of the toner according to this exemplary embodiment to form an image may provide high hot offset resistance.

There are known toners containing an amorphous polyester resin containing a dehydroabietic acid derivative and a diol as polymerization components. The molecule of the amorphous polyester resin has repeating units having a backbone derived from dehydroabietic acid (hereinafter also referred to as "dehydroabietic acid backbone") in the main chain thereof.

There are also known toners containing an amorphous polyester resin together with a crystalline polyester resin for improved toner fixability after fixing at relatively low temperatures (for example, below 160° C.).

However, the use of a toner containing an amorphous polyester resin that has repeating units having a dehydroabietic acid backbone in the main chain thereof and a crystalline polyester resin to form an image may result in low image strength after fixing at relatively low temperatures. When the image is folded, it may partially peel off, thus forming a white area.

In addition, the use of a toner containing an amorphous polyester resin to form an image may cause a hot offset.

Accordingly, the toner according to this exemplary embodiment contains a particular amorphous polyester resin that has repeating units having a dehydroabietic acid backbone in the main chain thereof and that has a weight average molecular weight of 30,000 to 80,000 or about 30,000 to about 80,000 and a particular crystalline polyester resin in which main chains having 6 to 10 carbon atoms alternate with main chains having 6 to 9 carbon atoms, with ester bonds therebetween.

Although the mechanism is not fully understood, the amorphous polyester resin, which has bulky dehydroabietic acid backbones repeating in the main chain thereof, may be highly compatible with the crystalline polyester resin, in which main chains having 6 to 10 carbon atoms alternate with main chains having 6 to 9 carbon atoms, with ester bonds therebetween. The high compatibility between the amorphous polyester resin and the crystalline polyester resin in the toner according to this exemplary embodiment may improve the image strength after fixing at relatively low temperatures.

The amorphous polyester resin contained in the toner according to this exemplary embodiment, which has bulky dehydroabietic acid backbones repeating in the main chain thereof, has a weight average molecular weight of 30,000 to 80,000 or about 30,000 to about 80,000.

If the amorphous polyester resin has a weight average molecular weight of less than 30,000, it would be prone to hot offset because of its excessive flexibility. If the amorphous polyester resin has a weight average molecular weight of more than 80,000, it would be poorly miscible with the crystalline polyester resin and thus make it difficult to provide sufficient image strength after fixing at relatively low temperatures.

The amorphous polyester resin preferably has a weight average molecular weight of 35,000 to 78,000 or about 35,000 to about 78,000, more preferably 40,000 to 75,000 or about 40,000 to about 75,000, and even more preferably 45,000 to 70,000 or about 45,000 to about 70,000.

The components of the toner according to this exemplary embodiment will now be described.

Particular Amorphous Polyester Resin

The toner according to this exemplary embodiment contains as a binder resin a particular amorphous polyester resin, derived from dehydroabietic acid, that has repeating units having a backbone derived from dehydroabietic acid in the main chain thereof and that has a weight average molecular weight of 30,000 to 80,000 or about 30,000 to about 80,000.

The term "backbone derived from dehydroabietic acid (dehydroabietic acid backbone)" refers to a divalent group formed by removing two hydrogen atoms from dehydroabietic acid contained in rosin, or a derivative thereof in which a carboxyl group is reduced to a hydroxy group (dehydroabietyl alcohol). Specifically, the term refers to the backbone represented by formula (B1) or (B2):

(B1)

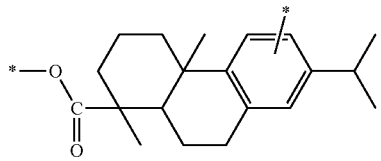

(B2)

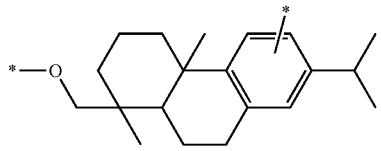

where * is a linking position.

The particular amorphous polyester resin has repeating units having the backbone represented by formula (B1) or (B2) in the main chain thereof and has a weight average molecular weight of 30,000 to 80,000 or about 30,000 to about 80,000.

The molecular weight distribution (the ratio (Mw/Mn) of the weight average molecular weight (Mw) to the number average molecular weight (Mn)) of the particular amorphous polyester resin is preferably, but not limited to, 8 to 18, more preferably 9 to 12.

If the particular amorphous polyester resin has a molecular weight distribution of 8 or more, it may contain a suitable amount of low-molecular-weight amorphous polyester resin. The low-molecular-weight amorphous polyester resin may function as a compatibilizer between the high-molecular-weight amorphous polyester resin and the crystalline polyester resin. As a result, the amorphous polyester resin may exhibit a higher compatibility with the crystalline polyester resin and thus provide a higher cold offset resistance.

If the particular amorphous polyester resin has a molecular weight distribution of 18 or less, it may contain a moderate amount of low-molecular-weight amorphous polyester resin and may thus maintain its hot offset resistance.

A molecular weight distribution within the above range may also provide high emulsion dispersibility and dispersion stability.

The weight average molecular weight (Mw) and the number average molecular weight (Mn) are determined by molecular weight measurements (polystyrene-equivalent) using gel permeation chromatography (GPC).

The particular amorphous polyester resin is preferably one of a polycondensate of a dehydroabietic acid derivative with a diol, a polycondensate of a dehydroabietyl alcohol derivative with a dicarboxylic acid, and a polycondensate of a dehydroabietic acid derivative or a dehydroabietyl alcohol derivative with a hydroxycarboxylic acid, more preferably a polycondensate of a dehydroabietic acid derivative with a diol.

The components of the polycondensates may also include polycarboxylic acids other than dehydroabietic acid derivatives and polyalcohols other than dehydroabietyl alcohol derivatives.

An example of a polycondensate of a dehydroabietic acid derivative with a dial is one having as repeating units a polyester backbone formed by polycondensation of a dial represented by the formula HO-$L^2$-OH (where $L^2$ is a divalent organic group) with a dehydroabietic acid derivative represented by general formula (C):

(C)

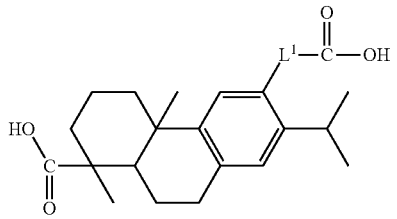

where $L^1$ is a divalent organic group having 3 or more carbon atoms.

Thus, the particular amorphous polyester resin may have repeating units represented by general formula (A):

(A)

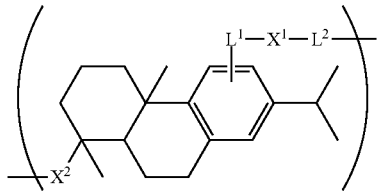

where $L^1$ is a divalent organic group having 3 or more carbon atoms, $L^2$ is a divalent organic group, $X^1$ is a carbonyloxy group or an oxycarbonyl ester group, and $X^2$ is an oxycarbonyl group or a carbonyloxymethyl group.

That is, the repeating units represented by general formula (A) are represented by one of general formulas (A1), (A2), (A3), and (A4):

(A1)

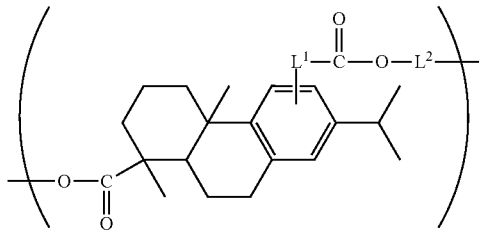

-continued (A2)

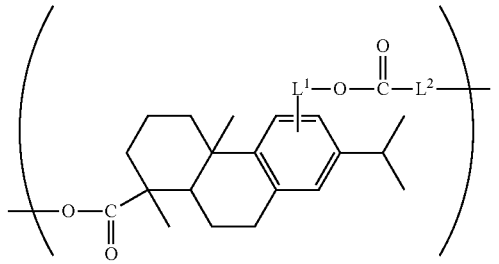

(A3)

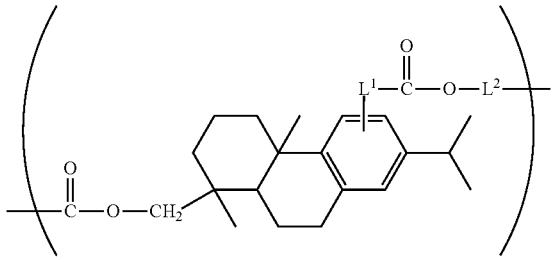

(A4)

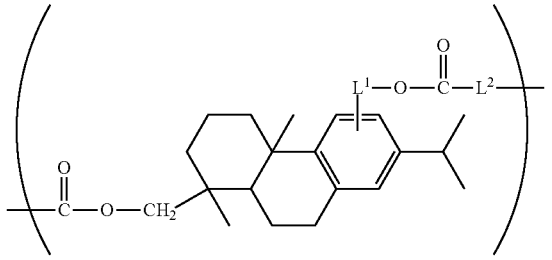

The divalent organic group represented by $L^1$ may be a divalent group that has 3 or more carbon atoms and a basic structural backbone formed by carbon atoms. The number of carbon atoms may be, for example, but not limited to, up to 30 (preferably, up to 25). This may allow the particular amorphous polyester resin to have a glass transition temperature of 80° C. or lower.

For example, the divalent organic group represented by $L^1$ may be a divalent organic group having 3 or more carbon atoms that is composed of at least one group selected from the group consisting of an oxygen atom, a carbonyl group, an alkylene group, an alkenylene group, an arylene group, an aralkylene group, and a divalent group represented by general formula (D), described later.

Specifically, the divalent organic group represented by $L^1$ may be a divalent organic group having 3 or more carbon atoms that is composed of a divalent group such as an alkylene group, an alkenylene group, an arylene group, an aralkylene group, or a divalent group represented by general formula (D), or a combination thereof with at least one of an ether bond and a carbonyl bond.

The divalent organic group represented by $L^1$ may be unsubstituted or substituted.

The position to which $L^1$ is linked is preferably, but not limited to, the aromatic ring, more preferably the 12- or 14-position, with the isopropyl group located at the 13-position.

The alkylene group for $L^1$ is, for example, —$C_nH_{2n}$— (where n is an integer of 3 to 18, preferably 3 to 12) or —$C_mH_{2m}$-(cyclo-$C_6H_{10}$)—$C_nH_{2n}$— (where m and n are independently an integer of 0 to 4, preferably 1 or 2, and are not simultaneously 0). Examples of such alkylene groups include —$C_3H_6$—, —$C_4H_8$—, —$C_8H_{16}$—, —$C_{10}H_{20}$—, —$CH_2$—$CH(CH_3)$—, —$CH_2$(cyclo-$C_6H_{10}$)$CH_2$—, and trans-1,4-cyclohexylene. These groups may be cyclic or noncyclic, and if they are noncyclic, they may be linear or branched.

The alkenylene group for L' is, for example, —$C_nH_{2n-2}$— (where n is an integer of 3 to 18, preferably 3 to 12). Examples of such alkenylene groups include —$C_3H_4$—, —$C_4H_6$—, —$C_8H_{14}$—, —$C_{10}H_{18}$—, —$CH_2$—$CH$═$C(CH_3)$—, and —$CH_2CH_2$—$C$(═$CH_2$)—. These groups may be cyclic or noncyclic, and if they are noncyclic, they may be linear or branched.

The arylene group for $L^1$ is, for example, phenylene, biphenylene, naphthylene, or —$C_6H_4(C_nH_{2n})C_6H_4$— (where n is an integer of 1 to 8, preferably 1 to 4). Examples of such arylene groups include 1,4-phenylene, 1,3-phenylene, 4,4'-biphenylene, 2,6-naphthylene, and —$C_6H_4C(CH_3)_2C_6H_4$—. The alkyl and alkylene groups that may be contained in these groups may be cyclic or noncyclic, and if they are noncyclic, they may be linear or branched.

The aralkylene group for $L^1$ is, for example, —$C_mH_{2m}C_6H_4C_nH_{2n}$— (where m and n are independently an integer of 0 to 4, preferably 1 to 2, and are not simultaneously 0). Examples of such aralkylene groups include —$CH_2C_6H_4CH_2$— and —$CH_2CH_2C_6H_4CH_2CH_2$—. The alkyl and alkylene groups that may be contained in these groups may be cyclic or noncyclic, and if they are noncyclic, they may be linear or branched.

Examples of organic groups for $L^1$ that are composed of at least one group selected from the group consisting of an ether bond (—O—), a carbonyl bond (—CO—), an alkylene group, an alkenylene group, an arylene group, and an aralkylene group include —$C_mH_{2m}(OC_nH_{2n})_k$— (where k is an integer of 1 to 8, preferably 1 to 3, and m and n are independently an integer of 2 to 4, preferably 2 or 3); —$C_mH_{2m}OC_6H_4OC_nH_{2n}$— (where m and n are independently an integer of 2 to 10, preferably 2 to 4); *—C(═O)—$C_nH_{2n}$— (where n is an integer of 2 to 10, preferably 2 to 8); and *—C(═O)—$C_nH_{2n-2}$— (where n is an integer of 2 to 10, preferably 2 to 8).

In the formulas, * is a position linked to the aromatic ring (for example, to the 12-position) of the dehydroabietic acid in general formula (A).

Examples of such organic groups include —$CH_2CH_2OCH_2CH_2$—, —$CH_2CH_2OCH_2CH_2)_2$—, —$CH_2CH_2(OCH_2CH_2)_3$—, —$CH_2CH_2OC_6H_4OCH_2CH_2$—, —$CH_2CH_2$OCO-1,4-$C_6H_4COOCH_2CH_2$—, —$CH_2CH_2$OCO-1,3-$C_6H_4COOCH_2CH_2$—, —$C_3H_6$OCO-1,4-$C_6H_4COOC_3H_6$—, —$C_4H_8$OCO-1,4-$C_6H_4COOC_4H_8$—, *—C(═O)—$C_2H_4$—, *—C(═O)—$C_3H_6$—, *—C(═O)—$C_4H_8$—, *—C(═O)—$C_8H_{16}$, *—C(═O)CH═CH—, *—C(═O)$CH_2C$(═$CH_2$)—, and *—C(═O)CH═$C(CH_3)$—. These groups may be cyclic or noncyclic, and if they are noncyclic, they may be linear or branched.

In the formulas, * is a position linked to the aromatic ring (for example, to the 12-position) of the dehydroabietic acid in general formula (A).

$L^1$ may have a dehydroabietic acid backbone. An example of $L^1$ having a dehydroabietic acid backbone is a divalent organic group represented by general formula (D):

(D)

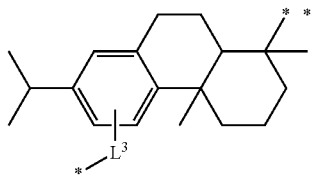

where $L_3$ is a single bond or a divalent organic group having 1 to 12 carbon atoms, * is a position linked to the aromatic ring in general formula (A), and ** is a position linked to $X^1$.

The divalent organic group represented by $L^3$ is, for example, an alkylene group that may have an ether bond, a carbonyl bond, or an ester bond (—COO— or —COO—). Examples of such divalent organic groups include —$C_nH_{2n}$— (where n is an integer of 1 to 12, preferably 1 to 3, and more preferably 1); —O—$C_nH_{2n}$—O— (where n is an integer of 2 to 12, preferably 2 to 8, and more preferably 2 to 4); —O—$(C_nH_{2n}O)_m$— (where m is an integer of 1 to 6, preferably 1 to 4, and more preferably 1 or 2, n is an integer of 2 to 6, preferably 2 to 4, and more preferably 2); —C(═O)O—$C_nH_{2n}$—OC(═O)— (where n is an integer of 2 to 10, preferably 3 to 8, and more preferably 5 to 8); —C(═O)—$C_nH_{2n}$—C(═O)— (where n is an integer of 2 to 10, preferably 3 to 8, and more preferably 5 to 8).

Specific examples of divalent organic groups represented by $L^3$ include —$CH_2$—, —$C_3H_6$—, —$C_4H_8$—, —$C_8H_{16}$—, —$C_{10}H_{20}$—, —$CH_2CH_2OCH_2CH_2$—, —$OCH_2CH_2OCH_2CH_2O$—, —$OCH_2CH_2CH_2O$—, —$OCH_2CH_2CH_2CH_2O$—, —C(═O)$OC_2H_4$OC(═O)—, —C(═O)$OC_3H_6$OC(═O)—, —C(═O)$OC_8H_{16}$OC(═O)—, —C(═O)$OC_{10}H_{20}$OC(═O)—, —C(═O)$C_2H_4$C(═O)—, —C(═O)$C_3H_6$C(═O)—, —C(═O)$C_8H_{16}$C(═O)—, and —C(═O)$C_{10}H_{20}$C(═O)—.

The position to which $L^3$ is linked is preferably, but not limited to, the aromatic ring, more preferably the 12- or 14-position, with the isopropyl group located at the 13-position.

Examples of divalent organic groups represented by $L^1$ include —$C_3H_6$—, —$C_4H_8$—, —$C_8H_{16}$—, —$C_{10}H_{20}$—, 1,4-phenylene, 1,3-phenylene, —$CH_2C_6H_4CH_2$—, —$CH_2CH_2C_6H_4CH_2CH_2$—, —$CH_2CH_2OCH_2CH_2$—, —$CH_2CH_2(OCH_2CH_2)_2$—, —$CH_2CH_2(OCH_2CH_2)_3$—, —$CH_2CH_2OC_6H_4OCH_2CH_2$—, —$CH_2CH_2$OCO-1,4-$C_6H_4COOCH_2CH_2$—, —$CH_2CH_2$OCO-1,3-$C_6H_4COOCH_2CH_2$—, —$C_3H_6$OCO-1,4-$C_6H_4COOC_3H_6$—, —$C_4H_8$OCO-1,4-$C_6H_4COOC_4H_8$—, —C(═O)—$C_2H_4$—, —C(═O)—$C_3H_6$—, —C(═O)—$C_4H_8$—, —C(═O)—$C_8H_{16}$—, —C(═O)CH═CH—, —C(═O)$CH_2C$(═$CH_2$)—, —C(O)CH═$C(CH_3)$—, and divalent organic groups represented by the following structural formulas:

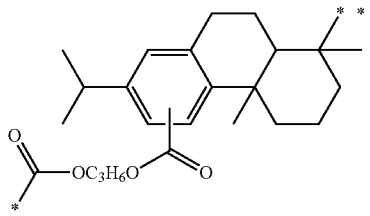

-continued

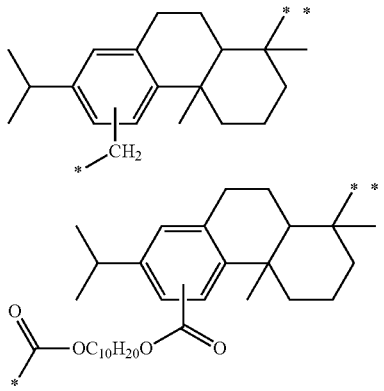

Among these groups, $L^1$ is preferably an organic group composed of at least one group selected from the group consisting of an oxygen atom, a carbonyl group, an alkylene group, and a divalent group represented by general formula (D). In particular, $L^1$ is preferably —$C_nH_{2n}$— (where n is an integer of 3 to 18, preferably 3 to 12) such as —$C_3H_6$—, —$C_4H_8$—, —$C_8H_{16}$—, or —$C_{10}H_{20}$—; *—C(═O)—$C_nH_{2n}$— (where n is an integer of 2 to 10, preferably 2 to 8) such as —C(═O)—$C_3H_6$—, —C(═O)—$C_4H_8$—, or —C(═O)—$C_8H_{16}$—; or a divalent group represented by general formula (D), more preferably *—C(═O)—$C_nH_{2n}$— or a divalent group represented by general formula (D).

In the formulas, * is a position linked to the aromatic ring (for example, to the 12-position) of the dehydroabietic acid in general formula (A).

The divalent organic group represented by $L^2$ may be any divalent group having a basic structural backbone formed by carbon atoms. For example, the divalent organic group represented by $L^2$ may contain an alkylene group having 3 or more carbon atoms, an arylene group, or an aralkylene group so that the particular amorphous polyester resin may have a glass transition temperature of 80° C. or lower. These organic groups may further contain at least one of an ether bond and an ester bond (—COO— or —OCO—).

Examples of alkylene groups for $L^2$ include the alkylene groups illustrated for $L^1$.

Examples of arylene groups for $L^2$ include the arylene groups illustrated for $L^1$.

Examples of aralkylene groups for $L^2$ include the aralkylene groups illustrated for $L^1$.

Examples of organic groups for $L^2$ that contain an ether (—O—) or ester bond and an alkylene, arylene, or aralkylene group include —$C_mH_{2m}(OC_nH_{2n})_k$— (where k is an integer of 1 to 8, preferably 1 to 4, and m and n are independently an integer of 2 to 4, preferably 2 or 3); —$C_mH_{2m}OC_6H_4OC_nH_{2n}$— (where m and n are independently an integer of 2 to 10, preferably 2 to 4); and —$C_mH_{2m}OCOC_6H_4COOC_nH_{2n}$— (where m and n are independently an integer of 2 to 10, preferably 2 to 4). Specific examples of such organic groups include —$CH_2CH_2OCH_2CH_2$—, —$CH_2CH_2(OCH_2CH_2)_2$—, —$CH_2CH_2(OCH_2CH_2)_3$—, —$CH_2CH_2OC_6H_4OCH_2CH_2$—, —$CH_2CH_2OCO$-1,4-$C_6H_4COOCH_2CH_2$—, —$CH_2CH_2OCO$-1,3-$C_6H_4COOCH_2CH_2$—, —$C_3H_6OCO$-1,4-$C_6H_4COOC_3H_6$—, and —$C_4H_8OCO$-1,4-$C_6H_4COOC_4H_8$—. These groups may be linear or branched.

Preferred examples of divalent organic groups represented by $L^2$ include —$C_3H_6$—, —$C_8H_{16}$—, —$C_{10}H_{20}$—, —$CH_2CH_2OCH_2CH_2$—, —$CH_2CH(CH_3)$—, —$CH_2CH_2(OCH_2CH_2)_2$—, —$CH_2CH_2(OCH_2CH_2)_3$—, —$C_6H_4C(CH_3)_2C_6H_4$—, —$CH_2CH_2OC_6H_4OCH_2CH_2$—, —$CH_2CH_2OCO$-1,4-$C_6H_4COOCH_2CH_2$—, —$CH_2CH_2OCO$-1,3-$C_6H_4COOCH_2CH_2$—, —$C_3H_6OCO$-1,4-$C_6H_4COOC_3H_6$—, —$C_4H_8OCO$-1,4-$C_6H_4COOC_4H_8$—, and combinations thereof.

Among these groups, alkylene groups and organic groups containing an ether or ester bond and an alkylene group are preferred. Examples of such groups include —$C_nH_{2n}$— (where n is an integer of 3 to 18, preferably 3 to 12) such as —$C_3H_6$—, —$C_4H_8$—, —$C_8H_{16}$—, and —$C_{10}H_{20}$—; and —$CH_2CH_2(OCH_2CH_2)_k$— (where k is an integer of 1 to 8, preferably 1 to 3) such as —$CH_2CH_2OCH_2CH_2$—, —$CH_2CH_2(OCH_2CH_2)_2$—, and —$CH_2CH_2(OCH_2CH_2)_3$—.

Examples of combinations of $L^1$ and $L^2$ in general formula (A) include combinations where:

$L^1$ is —$C_3H_6$—, —$C_4H_8$—, —$C_8H_{16}$—, —$C_{10}H_{20}$—, —$CH_2CH_2OCH_2CH_2$—, —$CH_2CH_2(OCH_2CH_2)_2$—, —$OCH_2CH_2CH_2$—, —$OCH_2CH_2CH_2CH_2$—, —C(═O)$C_2H_4$, —C(═O)$C_8H_{16}$, or a divalent organic group represented by general formula (D) (where $L^3$ is —$C_3H_6$—, —$C_4H_8$—, —$C_8H_{16}$—, —$C_{10}H_{20}$—, —$CH_2CH_2OCH_2CH_2$—, —C(═O)$CH_2CH_2C$(═O), or —C(═O)$C_8H_{16}C$(═O)—), or the like; and $L^2$ is —$C_3H_6$—, —$C_4H_8$—, —$C_8H_{16}$—, —$C_{10}H_{20}$—, —$CH_2CH_2OCH_2CH_2$—, —$CH_2CH_2(OCH_2CH_2)_2$—, —$C_6H_4C(CH_3)_2C_6H_4$—, —$CH_2CH_2OC_6H_4OCH_2CH_2$—, —$CH_2CH_2OCO$-1,4-$C_6H_4COOCH_2CH_2$—, —$CH_2CH_2OCO$-1,3-$C_6H_4COOCH_2CH_2$—, —$C_3H_6OCO$-1,4-$C_6H_4COOC_3H_6$—, —$C_4H_8OCO$-1,4-$C_6H_4COOC_4H_8$—, or the like.

In this exemplary embodiment, a combination is preferably employed where $L^1$ is an alkylene group, an organic group containing an ether or carbonyl bond and an alkylene group, or a divalent organic group represented by general formula (D), and $L^2$ is an alkylene group or an organic group containing an ether or ester bond and an alkylene group. More preferably, a combination is employed where $L^1$ is —$C_nH_{2n}$—, *—C(═O)—$C_nH_{2n}$—, or a divalent organic group represented by general formula (D), and $L^2$ is —$C_nH_{2n}$— or —$CH_2CH_2(OCH_2CH_2)_k$—. Even more preferably, a combination is employed where $L^1$ is a divalent organic group represented by general formula (D), and $L^2$ is —$C_nH_{2n}$— or —$CH_2CH_2(OCH_2CH_2)_k$—.

Although the particular amorphous polyester resin may be one of a polycondensate of a dehydroabietic acid derivative with a diol, a polycondensate of a dehydroabietyl alcohol derivative with a dicarboxylic acid, and a polycondensate of a dehydroabietic acid derivative or a dehydroabietyl alcohol derivative with a hydroxycarboxylic acid, the components of the polycondensates may also include polycarboxylic acids other than dehydroabietic acid derivatives and polyalcohols other than dehydroabietyl alcohol derivatives.

Thus, the particular amorphous polyester resin may have repeating units other than the repeating units having a dehydroabietic acid backbone in the main chain thereof (e.g., the repeating units represented by general formula (A)).

Examples of monomers that form the other repeating units (components of the polycondensates) include polycarboxylic acids and polyalcohols known in the art as components for polyester.

Examples of polycarboxylic acids include aromatic polycarboxylic acids such as terephthalic acid, isophthalic acid, 1,4-naphthalenedicarboxylic acid, trimellitic acid, pyromellitic acid, and 2,6-naphthalenedicarboxylic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, dimer acid, branched-chain alkylsuccinic acids having an alkyl group having 1 to 20 carbon atoms, and branched-chain alkenylsuccinic acids having an alkenyl group having 1 to 20 carbon atoms (e.g., octenylsuccinic acid, decenylsuccinic acid, dodecenylsuccinic acid, tetradecenylsuccinic acid, hexadecenyisuccinic acid, and octadecenylsuccinic acid); alicyclic carboxylic acids such as 1,4-cyclohexanedicarboxylic acid; anhydrides thereof; and alkyl (having 1 to 3 carbon atoms) esters thereof. These polycarboxylic acids may be used alone or in combination.

A dicarboxylic acid may be used in combination with a trivalent or higher-valent carboxylic acid (such as trimellitic acid, pyromellitic acid, or an anhydride thereof). The trivalent or higher-valent carboxylic acid may form a crosslinked or branched structure in the amorphous polyester resin, thus providing a higher fixability.

Examples of polyalcohols include aliphatic diols such as ethylene glycol, diethylene glycol, triethylene glycol, 1,2-propanediol (propylene glycol), 1,3-propanediol, 1,4-butanediol, 1,6-hexanediol, 1,8-octanediol, 1,10-decanediol, and 1,12-dodecanediol; alicyclic dials such as cyclohexanediol, cyclohexanedimethanol, and hydrogenated bisphenol A; aromatic dials such as hydroquinone, 4,4'-biphenol, 2,2-bis(4-hydroxyphenyl)propane, 1,4-bis(2-hydroxyethoxy)benzene, bisphenol A ethylene oxide adduct, and bisphenol A propylene oxide adduct. These polyalcohols may be used alone or in combination.

A diol may be used in combination with a trivalent or higher-valent alcohol (such as glycerol, trimethylolpropane, or pentaerythritol). The trivalent or higher-valent alcohol may form a crosslinked or branched structure in the amorphous polyester resin, thus providing a higher fixability.

If the particular amorphous polyester resin is a polycondensate of a dehydroabietic acid derivative and other polycarboxylic acids with a diol, the proportion of the dehydroabietic acid derivative in all carboxylic acids is preferably, but not limited to, 5 to 20 mol %, more preferably 8 to 15 mol %.

The particular amorphous polyester resin may have a linear hydrocarbon group having 4 to 14 or about 4 to about 14 carbon atoms as a side chain. The linear hydrocarbon group may reduce entanglement of the particular amorphous polyester resin to increase contact with the crystalline polyester resin. This may result in improved compatibility between the amorphous and crystalline polyester resins, thus providing a toner with high cold offset resistance. If the linear hydrocarbon group has 3 or less carbon atoms, it provides a limited effect of reducing entanglement of the particular amorphous polyester resin. If the linear hydrocarbon group has 15 or more carbon atoms, the particular amorphous polyester resin exhibits high flexibility and may thus affect the hot offset resistance.

The linear hydrocarbon group having 4 to 14 or about 4 to about 14 carbon atoms may be saturated or unsaturated and preferably has 6 to 12 carbon atoms.

To provide a particular amorphous polyester resin having a linear hydrocarbon group having 4 to 14 or about 4 to about 14 carbon atoms as a side chain in this exemplary embodiment, for example, a monomer having a linear hydrocarbon group having 4 to 14 or about 4 to about 14 carbon atoms as a side chain may be used as a polycarboxylic acid or polyalcohol used as a component for the polymer.

The proportion of the monomer in all monomers used for synthesis of the particular amorphous polyester resin is preferably, but not limited to, 1 to 10 mol %, more preferably 3 to 5 mol %.

To achieve high toner storage stability and fixability, the particular amorphous polyester resin may have a glass transition temperature of 40° C. to 80° C., more preferably 50° C. to 70° C. The glass transition temperature is measured by differential scanning calorimetry (DSC).

The acid value of the particular amorphous polyester resin is preferably, but not limited to, 5 to 40 mg KOH/g, more preferably 7 to 20 mg KOH/g. The acid value is measured according to a method specified by the Japanese Industrial Standards (JIS K 0070:1992).

An acid value within the above range may improve, for example, self-dispersibility and dispersion stability when an aqueous resin dispersion is prepared.

In this exemplary embodiment, the acid value may be controlled to the desired value in any manner. For example, the proportions of the monomers that form the polymer may be adjusted.

The particular amorphous polyester resin may be a polymer of a dehydroabietic acid derivative that has repeating units having a dehydroabietic acid backbone and that is chemically modified by introducing a substituent. Examples of substituents include halogen atoms (such as fluorine, chlorine, and bromine), alkyl groups (such as methyl and isopropyl), and alkoxy groups (such as methoxy and ethoxy).

With the rigid backbone derived from dehydroabietic acid and the flexible linking groups (such as $L^1$, $L^2$, and the comonomer diol), the particular amorphous polyester resin may have a good balance of mechanical strength, flexibility, and low-temperature workability.

Method for Manufacturing Particular Amorphous Polyester Resin

The particular amorphous polyester resin is manufactured by, for example, polycondensation of a dehydroabietic acid derivative represented by general formula (E) with a diol represented by HO-$L^2$-OH (where $L^2$ is as defined above), optionally together with other monomers (such as dicarboxylic acids):

(E)

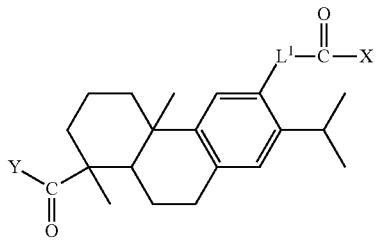

where X and Y may be the same or different and are each —OH, —OR, —OCOR, —OCOOR, —$OSO_2R$, a halogen atom (such as fluorine, chlorine, or bromine), imidazolyl, or triazolyl; R is an alkyl group (preferably having 1 to 4 carbon atoms, more preferably 1 to 3 carbon atoms), an aralkyl group (preferably having 7 to 10 carbon atoms, more preferably 7 to 9 carbon atoms), an aryl group (preferably having 6 to 12 carbon atoms, more preferably 6 to 9 carbon atoms), a hydroxyalkyl group (preferably having 2 to 6 carbon atoms, more preferably 2 to 4 carbon atoms), or the like. Among these groups, —OH and —OR are preferred, and —OH, —$OC_3H_6OH$, and —$OC_4H_8OH$ are particularly preferred.

$L^1$ is as defined above for general formula (A).

The diol may be any compound having two hydroxy groups. Examples of diols include aliphatic diols, alicyclic diols, and aromatic diols. Specifically, the diols described above may be used. The diols are used alone or in combination.

Examples of other monomers that may be copolymerized include dicarboxylic acids. Specifically, the dicarboxylic acids described above may be used.

The dehydroabietic acid derivative represented by general formula (E) used for manufacture of the particular amorphous polyester resin is obtained from rosin.

Rosin is a resin component extracted from pine resin. According to the method for extraction, rosin is typically classified into the three types: gum rosin, tall oil rosin, and wood rosin. Depending on, for example, the method for extraction and the origin of the pine, rosin is typically a mixture of diterpene resin acids such as abietic acid (1), neoabietic acid (2), palustric acid (3), levopimaric acid (4), dehydroabietic acid (5), pimaric acid (6), and isopimaric acid (7), as represented by the following structural formulas:

(1)

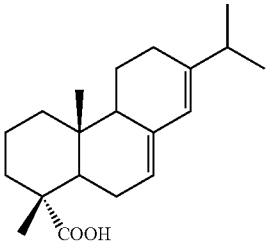

(2)

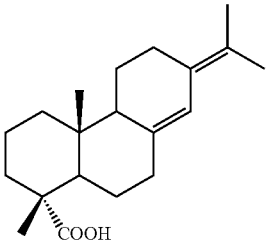

(3)

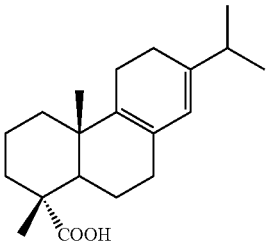

(4)

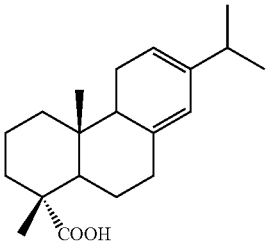

-continued (5)

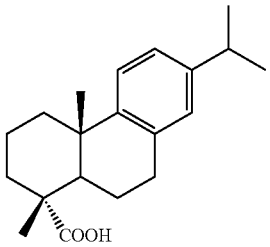

(6)

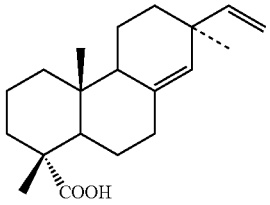

(7)

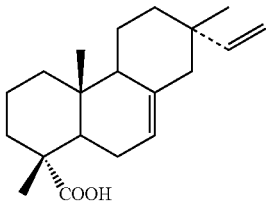

Among these diterpene resin acids, the compounds represented by formulas (1) to (4) are disproportionated, for example, by heating in the presence of an apatite catalyst. As a result, these compounds are modified into dehydroabietic acid (5) and the abietic acid of formula (8) below. The modification is performed according to, for example, Japanese Unexamined Patent Application Publication No. 2002-284732.

(8)

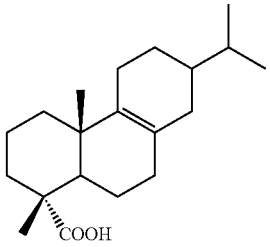

Thus, the dehydroabietic acid derivative used for manufacture of the particular amorphous polyester resin may be easily manufactured at low cost on an industrial scale by performing suitable chemical treatment on rosin, which is a mixture of various resin acids.

The 12-position of dehydroabietic acid has a high electron density and is therefore susceptible to various aromatic electrophilic substitution reactions such as acylation and halogenation. Thus, the 12-position may be substituted by a carboxyl-containing group through a known reaction. An example of a synthesis route of the particular amorphous polyester resin is illustrated below:

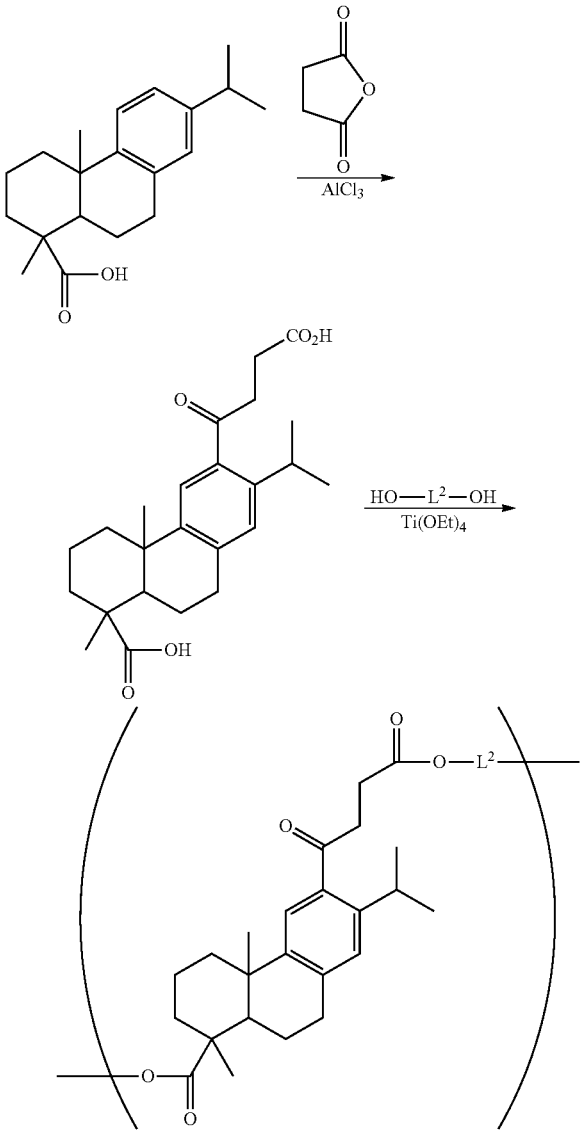

In the above synthesis route, the step of synthesizing the particular amorphous polyester resin may involve polycondensation of a compound represented by general formula (C) with a diol by a known method.

Examples of synthesis methods are described in "Shin Kobunshi Jikken Gaku (New Polymer Experiments) 3 Kobunshi No Gosei Hanno (Synthesis and Reactions of Polymers) (2)", pp. 78-95, Kyoritsu Shuppan Co., Ltd. (1996) (including transesterification, direct esterification, polycondensation using acid chlorides, low-temperature solution polymerization, high-temperature solution polycondensation, and interfacial polycondensation). In this exemplary embodiment, for example, transesterification or direct esterification may be used.

In this exemplary embodiment, a copolyester may be synthesized through the above synthesis route using a dehydroabietic acid derivative having a carboxyl group at the 12-position thereof in combination with other polycarboxylic acids. For example, a copolyester may be synthesized by a known method. A typical synthesis method includes heating the dehydroabietic acid derivative together with suitable amounts of diol and other dicarboxylic acids at elevated temperature (for example, 200° C. to 280° C.) under reduced pressure to effect polycondensation and removing the resulting low-boiling-point compounds, such as water and alcohol.

Alternatively, the particular amorphous polyester resin may be manufactured by, for example, polycondensation of a dehydroabietyl alcohol derivative represented by general formula (F1) with a dicarboxylic acid represented by general formula (F2), optionally together with other monomers:

(F1)

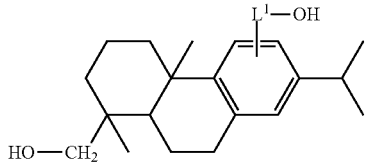

(F2)

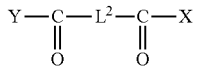

where $L^1$ and $L^2$ are as defined above for general formula (A); X and Y may be the same or different and are each —OH, —OR, —ODOR, —OCOOR, —$OSO_2R$, a halogen atom (such as fluorine, chlorine, or bromine), imidazolyl, or triazolyl; R is an alkyl group (preferably having 1 to 4 carbon atoms, more preferably 1 to 3 carbon atoms), an aralkyl group (preferably having 7 to 10 carbon atoms, more preferably 7 to 9 carbon atoms), an aryl group (preferably having 6 to 12 carbon atoms, more preferably 6 to 9 carbon atoms), or a hydroxyalkyl group (preferably having 2 to 6 carbon atoms, more preferably 2 to 4 carbon atoms). Among these groups, OH and —OR are preferred, and —OH and —$OCH_3$ are particularly preferred.

The dehydroabietyl alcohol derivative represented by general formula (F1) may be manufactured by reducing the carboxyl group of the dehydroabietic acid derivative as usual.

The method for polycondensation of the dehydroabietyl alcohol derivative represented by general formula (F1) with the dicarboxylic acid represented by general formula (F2) is as described above.

Alternatively, the particular amorphous polyester resin may be manufactured by, for example, polycondensation of a dehydroabietyl alcohol derivative represented by general formula (G1) with a hydroxycarboxylic acid derivative represented by general formula (G2), optionally together with other monomers:

(G1)

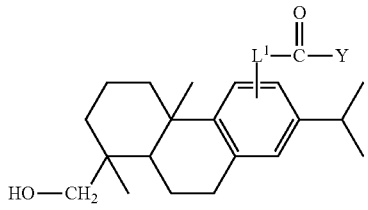

(G2)

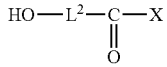

where $L^1$ and $L^2$ are as defined above for general formula (A); X and Y may be the same or different and are each —OH, —OR, —OCOR, —OCOOR, —$OSO_2R$, a halogen atom (such as fluorine, chlorine, or bromine), imidazolyl, or triazolyl; R is an alkyl group (preferably having 1 to 4 carbon atoms, more preferably 1 to 3 carbon atoms), an aralkyl group (preferably having 7 to 10 carbon atoms, more preferably 7 to 9 carbon atoms), an aryl group (preferably having 6 to 12 carbon atoms, more preferably 6 to 9 carbon atoms), or a hydroxyalkyl group (preferably having 2 to 6 carbon atoms, more preferably 2 to 4 carbon atoms). Among these groups, —OH and —OR are preferred, and —OH and —$OCH_3$ are particularly preferred.

The dehydroabietyl alcohol derivative represented by general formula (G1) may be manufactured by reducing the carboxyl group of the dehydroabietic acid derivative as usual.

The method for polycondensation of the dehydroabietyl alcohol derivative represented by general formula (G1) with the hydroxycarboxylic acid derivative represented by general formula (G2) is as described above.

Particular Crystalline Polyester Resin

The toner according to this exemplary embodiment contains a particular crystalline polyester resin as a binder resin.

The term "crystalline" means that the polyester resin exhibits a clear endothermic peak, rather than a stepwise change in the amount of heated absorbed, in DSC. Specifically, this term means that the half-width of the endothermic peak measured at a heating rate of 10° C./min is within 10° C.

The term "amorphous" means that the polyester resin exhibits an endothermic peak with a half-width above 10° C. or no clear endothermic peak.

The particular crystalline polyester resin contained in the toner according to this exemplary embodiment is at least one of the following crystalline polyester resins:

a crystalline polyester resin containing a dicarboxylic acid (C10) and a diol (C9) as polymerization components (hereinafter also referred to as "crystalline polyester resin (CR-1)"); and a crystalline polyester resin containing a dicarboxylic acid (C9) and a dial (C10) as polymerization components (hereinafter also referred to as "crystalline polyester resin (CR-2)").

The dicarboxylic acid (C10), the dicarboxylic acid (C9), the dial (C10), and the diol (C9) are defined as follows.

It should be noted that the term "dicarboxylic acid (C10)" encompasses the dicarboxylic acid (C9), and the term "diol (C10)" encompasses the diol (C9).

The dicarboxylic acid (C10) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 10.

The dicarboxylic acid (C9) is a dicarboxylic acid or a derivative thereof containing a first carbonyl group and a second carbonyl group coupled together by consecutive carbon atoms. The minimum number of consecutive carbon atoms from the carbon atom directly attached to the first carbonyl group to the carbon atom directly attached to the second carbonyl group is 6 to 9.

The diol (C10) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 10.

The dial (C9) is a diol containing a first hydroxy group and a second hydroxy group coupled together by consecutive carbon atoms. The minimum number of consecutive carbon atoms from the carbon atom directly attached to the first hydroxy group to the carbon atom directly attached to the second hydroxy group is 6 to 9.

The dicarboxylic acid (C9), the dicarboxylic acid (C10), the diol (C9), and the diol (C10) used as polymerization components for the particular crystalline polyester resin will now be described.

Dicarboxylic Acid (C9) and Dicarboxylic Acid (C10)

In the dicarboxylic acid (C9) and the dicarboxylic acid (C10), the first carbonyl group and the second carbonyl group are coupled together by consecutive carbon atoms. The divalent group having the consecutive carbon atoms and coupling the two carbonyl groups may be cyclic or noncyclic, and if they are noncyclic, they may be linear or branched, or if they are cyclic, they may be monocyclic or polycyclic.

The divalent group may be a divalent hydrocarbon group. The divalent hydrocarbon group may be saturated or unsaturated.

For the dicarboxylic acid (C9), the divalent hydrocarbon group is, for example, an alkylene group, a cycloalkylene group, an alkenylene group, an arylene group, or a combination thereof. The minimum number of consecutive carbon atoms from the carbon atom directly attached to the first carbonyl group to the carbon atom directly attached to the second carbonyl group is 6 to 9.

For the dicarboxylic acid (C9), the divalent hydrocarbon group preferably has a total of 6 to 18 carbon atoms, more preferably 6 to 12 carbon atoms, and even more preferably 6 to 9 carbon atoms.

For the dicarboxylic acid (C10), the divalent hydrocarbon group is, for example, an alkylene group, a cycloalkylene group, an alkenylene group, an arylene group, or a combination thereof. The minimum number of consecutive carbon atoms from the carbon atom directly attached to the first carbonyl group to the carbon atom directly attached to the second carbonyl group is 6 to 10.

For the dicarboxylic acid (C10), the divalent hydrocarbon group preferably has a total of 6 to 20 carbon atoms, more preferably 6 to 12 carbon atoms, and even more preferably 6 to 10 carbon atoms.

Examples of dicarboxylic acids (C9) and dicarboxylic acids (C10) include:

linear or branched octanedioic acid, nonanedioic acid, decanedioic acid, undecanedioic acid, dodecanedioic acid, and the like (saturated aliphatic dicarboxylic acids);

linear or branched octenedioic acid, nonenedioic acid, decenedioic acid, undecenedioic acid, dodecenedioic acid, and the like (unsaturated aliphatic dicarboxylic acids);

aromatic dicarboxylic acids such as 2,6-naphthalenedicarboxylic acid and 2,7-phenanthrenedicarboxylic acid; and anhydrides and lower alkyl esters of the above dicarboxylic acids (derivatives of the above dicarboxylic acids).

The divalent group coupling the two carbonyl groups in the dicarboxylic acid (C9) and the dicarboxylic acid (C10) may have a saturated linear hydrocarbon group so that the crystal structure may be easily formed. Specifically, the dicarboxylic acid (C9) and the dicarboxylic acid (C10) may be a saturated linear aliphatic dicarboxylic acid or a lower alkyl ester thereof.

Examples of such dicarboxylic acids (C9) include suberic acid (1,6-hexanedicarboxylic acid), azelaic acid (1,7-heptanedicarboxylic acid), sebacic acid (1,8-octanedicarboxylic acid), n-undecanedioic acid (1,9-nonanedicarboxylic acid), and lower alkyl esters thereof.

Examples of such dicarboxylic acids (C10) include suberic acid (1,6-hexanedicarboxylic acid), azelaic acid (1,7-heptanedicarboxylic acid), sebacic acid (1,8-octanedicarboxylic acid), n-undecanedioic acid (1,9-nonanedicarboxylic acid), n-dodecanedioic acid (1,10-decanedicarboxylic acid), and lower alkyl esters thereof.

The above dicarboxylic acids (C9) may be used alone or in combination.

The above dicarboxylic acids (C10) may be used alone or in combination.

Diol (C9) and Diol (C10)

In the diol (C9) and the diol (C10), the first hydroxy group and the second hydroxy group are coupled together by consecutive carbon atoms. The divalent group having the consecutive carbon atoms and coupling the two hydroxy groups may be cyclic or noncyclic, and if they are noncyclic, they may be linear or branched, or if they are cyclic, they may be monocyclic or polycyclic.

The divalent group may be a divalent hydrocarbon group. The divalent hydrocarbon group may be saturated or unsaturated.

For the dial (C9), the divalent hydrocarbon group is, for example, an alkylene group, a cycloalkylene group, an alkenylene group, an arylene group, or a combination thereof. The minimum number of consecutive carbon atoms from the carbon atom directly attached to the first hydroxy group to the carbon atom directly attached to the second hydroxy group is 6 to 9.

For the diol (C9), the divalent hydrocarbon group preferably has a total of 6 to 18 carbon atoms, more preferably 6 to 12 carbon atoms, and even more preferably 6 to 9 carbon atoms.

For the diol (C10), the divalent hydrocarbon group is, for example, an alkylene group, a cycloalkylene group, an alkenylene group, an arylene group, or a combination thereof. The minimum number of consecutive carbon atoms from the carbon atom directly attached to the first hydroxy group to the carbon atom directly attached to the second hydroxy group is 6 to 10.

For the diol (C10), the divalent hydrocarbon group preferably has a total of 6 to 20 carbon atoms, more preferably 6 to 12 carbon atoms, and even more preferably 6 to 10 carbon atoms.

Examples of diols (C9) and diols (C10) include:

linear or branched octanediol, nonanediol, decanediol, undecane diol, dodecanediol, and the like (saturated aliphatic diols);

linear or branched octanediol, nonenediol, decenediol, undecenediol, dodecenediol, and the like (unsaturated aliphatic diols); and aromatic diols such as 2,6-naphthalenediol and bisphenol A.

The divalent group coupling the two hydroxy groups in the diol (C9) and the diol (C10) may have a saturated linear hydrocarbon group so that the crystal structure may be easily formed. Specifically, the diol (C9) and the diol (C10) may be a saturated linear aliphatic diol.

Examples of such dials (C9) include 1,6-hexanediol, 1,7-heptanediol, 1,8-octanediol, and 1,9-nonanediol.

Examples of such diols (C10) include 1,6-hexanediol, 1,7-heptanediol, 1,8-octanediol, 1,9-nonanediol, and 1,10-decanediol.

The above dials (C9) may be used alone or in combination.

The above diols (C10) may be used alone or in combination.

To achieve a higher compatibility with the particular amorphous polyester resin and a higher image strength, the particular crystalline polyester resin may be a crystalline polyester resin containing a dicarboxylic acid (C9) and a diol (C9) as polymerization components.

For example, the particular crystalline polyester resin may be a crystalline polyester resin containing as polymerization components at least one dicarboxylic acid selected from the group consisting of suberic acid (1,6-hexanedicarboxylic acid), azelaic acid (1,7-heptanedicarboxylic acid), sebacic acid (1,8-octanedicarboxylic acid), n-undecanedioic acid (1,9-nonanedicarboxylic acid), and lower alkyl esters thereof; and at least one diol selected from the group consisting of 1,6-hexanediol, 1,7-heptanediol, 1,8-octanediol, and 1,9-nonanediol. The crystalline polyester resin may be composed only of the above dicarboxylic acid and the above diol.

Other Monomers

The crystalline polyester resin (CR-1) may contain monomers other than the dicarboxylic acid (C10) and the diol (C9) as polymerization components. The crystalline polyester resin (CR-2) may contain monomers other than the dicarboxylic acid (C9) and the dial (C10) as polymerization components.

Examples of other monomers include the following monomers:

a dicarboxylic acid or a derivative thereof containing a first carbonyl group and a second carbonyl group coupled together by consecutive carbon atoms, where the minimum number of consecutive carbon atoms from the carbon atom directly attached to the first carbonyl group to the carbon atom directly attached to the second carbonyl group is 11 or more (hereinafter referred to as "dicarboxylic acid (C11)");

a dicarboxylic acid or a derivative thereof containing a first carbonyl group and a second carbonyl group coupled together by consecutive carbon atoms, where the minimum number of consecutive carbon atoms from the carbon atom directly attached to the first carbonyl group to the carbon atom directly attached to the second carbonyl group is 5 or less (hereinafter referred to as "dicarboxylic acid (C5)");

a diol containing a first hydroxy group and a second hydroxy group coupled together by consecutive carbon atoms, where the minimum number of consecutive carbon atoms from the carbon atom directly attached to the first hydroxy group to the carbon atom directly attached to the second hydroxy group is 11 or more (hereinafter referred to as "diol (C11)"); and a diol containing a first hydroxy group and a second hydroxy group coupled together by consecutive carbon atoms, where the minimum number of consecutive carbon atoms from the carbon atom directly attached to the first hydroxy group to the carbon atom directly attached to the second hydroxy group is 5 or less (hereinafter referred to as "diol (C5)").

The above monomers may be omitted because they might affect the compatibility between the particular crystalline polyester resin and the particular amorphous polyester resin.

The proportion of the dicarboxylic acid (C10) in the carboxylic acids used for synthesis of the crystalline polyester resin (CR-1) is preferably 80 mol % or more, more preferably 90 mol % or more, and even more preferably 100 mol %, to achieve high resin crystallinity and toner fixability.

The proportion of the diol (C9) in the alcohols used for synthesis of the crystalline polyester resin (CR-1) is preferably 80 mol % or more, more preferably 90 mol % or more, and even more preferably 100 mol %, to achieve high resin crystallinity and toner fixability.

The proportion of the dicarboxylic acid (C9) in the carboxylic acids used for synthesis of the crystalline polyester resin (CR-2) is preferably 80 mol % or more, more preferably 90 mol % or more, and even more preferably 100 mol %, to achieve high resin crystallinity and toner fixability.

The proportion of the diol (C10) in the alcohols used for synthesis of the crystalline polyester resin (CR-2) is preferably 80 mol % or more, more preferably 90 mol % or more, and even more preferably 100 mol %, to achieve high resin crystallinity and toner fixability.

The particular crystalline polyester resin may be synthesized as usual at a polymerization temperature of 180° C. to 230° C. For example, the reaction may be allowed to proceed while removing water and alcohol resulting from condensation by reducing the pressure in the reaction system.

Examples of catalysts used for synthesis of the particular crystalline polyester resin include compounds of alkali metals such as sodium and lithium; compounds of alkaline earth metals such as magnesium and calcium; compounds of metals such as zinc, manganese, antimony, titanium, tin, zirconium, and germanium; phosphorous acid compounds; phosphoric acid compounds; and amine compounds.

The particular crystalline polyester resin preferably has a melting temperature of 50° C. to 100° C., more preferably 55° C. to 90° C., and even more preferably 60° C. to 80° C., to achieve high toner storage stability and fixability.

The melting temperature of the particular crystalline polyester resin is determined as the peak temperature of an endothermic peak obtained by DSC.

The particular crystalline polyester resin may have a weight average molecular weight of 1,000 to 30,000 or about 1,000 to about 30,000 to achieve less fixing variation and high image strength as well as high toner fixability.

The weight average molecular weight of the particular crystalline polyester resin is measured by GPC.

Other Resins

The toner according to this exemplary embodiment may contain resins other than the polyester resins as binder resins. Examples of resins other than the polyester resins include homopolymers and copolymers of styrenes such as styrene, parachlorostyrene, and α-methylstyrene; homopolymers and copolymers of vinyl esters such as methyl acrylate, ethyl acrylate, n-propyl acrylate, butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers and copolymers of vinyl nitriles such as acrylonitrile and methacrylonitrile; homopolymers and copolymers of vinyl ethers such as vinyl methyl ether and vinyl isobutyl ether; homopolymers and copolymers of vinyl ketones such as vinyl methyl ketone, vinyl ethyl ketone, and vinyl isopropenyl ketone; homopolymers and copolymers of olefins such as ethylene, propylene, and butadiene; and non-vinyl condensed resins such as epoxy resins, urethane resins, polyamide resins, cellulose resins, and polyether resins.

The proportion of the particular amorphous polyester resin in the binder resins that form the toner according to this exemplary embodiment is preferably 70% by mass or more, more preferably 75% by mass or more.

The proportion of the crystalline polyester resin (CR) in the binder resins that form the toner according to this exemplary embodiment is preferably 10% by mass or more, more preferably 15% by mass or more.

The proportion of the crystalline polyester resin (CR) in the total amount of particular amorphous polyester resin and crystalline polyester resin (CR) in the toner according to this exemplary embodiment is preferably 10% to 30% by mass, more preferably 15% to 25% by mass.

Release Agent

The toner according to this exemplary embodiment may contain a release agent.

Examples of release agents include mineral waxes such as montan wax, ozokerite, ceresin, paraffin wax, microcrystalline wax, and Fischer-Tropsch wax; petroleum waxes, natural gas waxes, and modified products thereof; low-molecular-weight polyolefins such as polyethylene, polypropylene, and polybutene; silicone resins that exhibit a softening point when heated; fatty acid amides such as oleamide, erucamide, ricinoleamide, and stearamide; vegetable waxes such as carnauba wax, rice wax, candelilla wax, Japan wax, and jojoba oil; and animal waxes such as beeswax. These may be used alone or in combination.

Examples of modifying aids include higher alcohols having 10 to 18 carbon atoms and mixtures thereof and higher fatty acid monoglycerides having 16 to 22 carbon atoms and mixtures thereof.

The release agent preferably has a melting temperature (° C.) of 50° C. to 100° C., more preferably 60° C. to 95° C.

The proportion of the release agent in the total solid content of the toner is preferably 1% to 25% by mass, more preferably 5% to 15% by mass, to provide high releasability and toner fluidity.

Colorant

The toner according to this exemplary embodiment may contain a colorant. The colorant may be a dye or a pigment. For example, a pigment may be used to provide high light resistance and water resistance. Also available are surface-treated colorants and pigment dispersions.

The colorant may be any colorant known in the art. Examples of colorants include carbon black, aniline black, aniline blue, calco oil blue, chrome yellow, ultramarine blue, DuPont oil red, quinoline yellow, methylene blue chloride, phthalocyanine blue, malachite green oxalate, lamp black, rose bengal, quinacridone, benzidine yellow, C.I. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The type of colorant is selected to prepare, for example, a yellow toner, a magenta toner, a cyan toner, or a black toner.

The content of the colorant in the toner according to this exemplary embodiment may be 1 to 30 parts by mass per 100 parts by mass of the binder resins.

Other Components

The toner according to this exemplary embodiment may contain other components such as internal additives and charge control agents.

Examples of internal additives include magnetic materials, for example, metals such as ferrite, magnetite, reduced iron, cobalt, nickel, and manganese and alloys and compounds thereof.

Examples of charge control agents include quaternary ammonium salts; nigrosine compounds; complex dyes such as aluminum complex dyes, iron complex dyes, and chromium complex dyes; and triphenylmethane pigments.

The total content of the other components is preferably, for example, 0.01% to 5% by mass, more preferably 0.5% to 2% by mass.

External Additive

The toner according to this exemplary embodiment may contain as an external additive various components such as inorganic particles (inorganic powders) and organic particles.

The external additive may be any type of external additive, and known external additives such as inorganic particles and organic particles may be used. Examples of external additives include inorganic particles such as silica, titania, alumina, cerium oxide, strontium titanate, calcium carbonate, magnesium carbonate, and calcium phosphate; metal soaps such as zinc stearate; and organic resin particles such as fluorine-containing resin particles, silica-containing resin particles, and nitrogen-containing resin particles.

The external additive may be surface-treated, depending on the purpose. For example, the external additive may be surface-treated with a hydrophobing agent such as a silane coupling agent, a titanium coupling agent, or silicone oil.

Toner Properties

The toner according to this exemplary embodiment preferably has a volume average particle size D50v of 2 to 8 μm or about 2 to about 8 μm, more preferably 3 to 6 μm or about 3 to about 6 μm. If the toner has a volume average particle size D50v of 2 μm or more, the toner may have high fluidity and therefore high chargeability. In addition, such a toner may have a narrow charge distribution and may thus be less likely to cause background fogging or to fall off a developing device. Furthermore, if the toner has a volume average particle size D50v of 2 μm or more, the toner may provide high cleanability. If the toner has a volume average particle size D50v of 8 μm or less, the toner may provide a sufficient image resolution to meet the high image quality requirements in recent years.

The toner according to this exemplary embodiment preferably has a volume average geometric size distribution GSDv of 1.0 to 1.3 or about 1.0 to about 1.3, more preferably 1.1 to 1.3 or about 1.1 to about 1.3, and even more preferably 1.15 to 1.24 or about 1.15 to about 1.24. If the volume average geometric size distribution GSDv falls within the above ranges, the toner may contain fewer coarse particles and fine particles and thus exhibit less aggregation, so that the toner may be less likely to cause charge defects and transfer defects. If the volume average geometric size distribution GSDv is 1.0 or more, the toner may provide high productivity.

The volume average particle size D50v and the volume average geometric size distribution GSDv are calculated from the particle size distribution of the toner measured using a Coulter Multisizer II (available from Beckman Coulter, Inc.) with an aperture diameter of 100 μm. The particle size distribution is measured after the toner is dispersed in an aqueous electrolyte solution (ISOTON aqueous solution) and is sonicated for 30 seconds or more.

The toner according to this exemplary embodiment preferably has a shape factor SF1 of 110 to 140 or about 110 to about 140, more preferably 115 to 135 or about 115 to about 135, and even more preferably 120 to 130 or about 120 to about 130. If the toner has a shape factor SF1 of 110 or more, it may be less likely to cause cleaning defects after transfer. If the toner has a shape factor SF1 of 140 or less, it may provide high transfer efficiency and image fineness, thus forming a high-quality image.

The shape factor SF1 is calculated by the following equation:

$$SF1=(ML^2/A)\times(\pi/4)\times 100$$

where ML is the maximum length (μm) of the toner, and A is the projected area ($\mu m^2$) of the toner.

Specifically, the shape factor SF1 is calculated by converting a light micrograph or scanning electron micrograph of toner particles into numerical form using an image analyzer. For example, the shape factor SF1 is calculated as follows. A micrograph of toner particles dispersed over a glass slide is captured using a video camera and is fed to a LUZFX FT image analyzer (available from Nireco Corporation). The maximum lengths (ML) and projected areas (A) of 50 toner particles are measured, and the shape factors SF1 of the individual toner particles are calculated by the above equation and are averaged.

Method for Manufacturing Toner

The toner according to this exemplary embodiment may be manufactured by any method. For example, toner particles are prepared by a dry process such as pulverization or by a wet process such as aggregation coalescence or suspension polymerization, followed by adding an external additive to the toner particles to prepare a toner. For ease of shape control of the toner and to reduce the particle size and narrow the particle size distribution of the toner, aggregation coalescence and suspension polymerization are preferred, and aggregation coalescence is more preferred. A method for preparing a toner by aggregation coalescence will now be described.

For example, an aggregation coalescence process includes:

a step of preparing dispersions (such as a resin particle dispersion and a release agent dispersion) of the materials for forming the toner particles in a dispersion medium (dispersion-preparing step);

a step of mixing the above dispersions and adding an coagulant to the mixed dispersion to form aggregated particles containing the materials for forming the toner particles (aggregating step); and a step of coalescing the aggregated particles by heating the aggregated particle dispersion in which the aggregated particles are dispersed to form coalesced particle (coalescing step).

The individual steps will now be described in detail. Although the method described below is a method for preparing toner particles containing a colorant, the colorant may be omitted. It should be understood that other additives may be used.

Dispersion-Preparing Step

In the dispersion-preparing step, emulsions are prepared by dispersing each of the materials for forming the toner particles in a dispersion medium. The resin particle dispersion, the release agent dispersion, and the colorant dispersion will now be described.

Resin Particle Dispersion

The resin particle dispersion may be prepared by shearing a mixture of a dispersion medium and a resin using a disperser. The particles may be formed while heating the mixture to decrease the viscosity of the resin. A dispersant may be used to stabilize the dispersed resin particles.

The dispersion medium used for the resin particle dispersion and other dispersions may be an aqueous medium. Examples of aqueous media include water and alcohols. For example, water may be used alone.

If the resin is oily and soluble in a solvent with relatively low solubility in water, it may be dissolved in the solvent and be dispersed in water together with a dispersant and a polymer electrolyte, followed by evaporating off the solvent under heating or reduced pressure.

Examples of dispersants include water-soluble polymers such as polyvinyl alcohol, methylcellulose, ethylcellulose, hydroxyethylcellulose, carboxymethylcellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; nonionic surfactants such as polyoxyethylene alkyl ether, polyoxyethylene alkyl phenyl ether, and polyoxyethylene alkylamine; and inorganic salts such as tricalcium phosphate, aluminum hydroxide, calcium sulfate, calcium carbonate, and barium carbonate.

Examples of dispersers used for preparing the resin particle dispersion include homogenizers, homomixers, pressure kneaders, extruders, and media dispersers.

The resin particles preferably have a volume average particle size of 1 μm or less, more preferably 0.01 to 1 μm, even more preferably 50 to 400 nm, and particularly preferably 70 to 350 nm.

If the resin particles have a volume average particle size within the above ranges, the resulting toner may have a narrow particle size distribution and contain few free particles, thus providing high performance and reliability. In addition, such a toner may have little variation in composition and thus have little variation in performance and reliability.

The volume average particle size of the particles, such as the resin particles, contained in the dispersions is measured using a laser diffraction particle size distribution analyzer (LA-920 available from Horiba, Ltd.)

Release Agent Dispersion

The release agent dispersion is prepared by dispersing the release agent in water together with an ionic surfactant and a polymer electrolyte such as a polymer acid or polymer base, heating the mixture at or above the melting temperature of the release agent, and applying high shear using a homogenizer or pressure discharge disperser. Thus, release agent particles having a volume average particle size of 1 μm or less (preferably, 0.1 to 0.5 μm) are dispersed in a dispersion medium. The dispersion medium used for the release agent dispersion may be the same as the dispersion medium used to disperse the resin.

For the dispersion treatment, an inorganic compound may be added to the dispersion. Examples of inorganic compounds include polyaluminum chloride (PAC), aluminum sulfate, high-basicity PAC, polyaluminum hydroxide, and aluminum chloride.

Colorant Dispersion

The colorant dispersion may be prepared by a common dispersion process, such as using a rotary shear homogenizer, a ball mill with media, a sand mill, or a DYNO-MILL. The colorant dispersion may be an aqueous colorant dispersion prepared using a surfactant or may be an organic solvent colorant dispersion prepared using a dispersant. The surfactant or dispersant used for the colorant dispersion may be the same as the surfactant or dispersant used to disperse the binder resin.

The content of the colorant in the colorant dispersion may be generally 5% to 50% by mass, specifically 10% to 40% by mass. If the content falls within the above ranges, the colorant particles may have a narrow particle size distribution.

The particles contained in the colorant dispersion may have a volume average particle size (median size) of 2 μm or less, specifically 0.2 to 1.5 μm, and more specifically 0.3 to 1 μm.

The release agent and other internal additives may be dispersed in the resin particle dispersion.

Aggregating Step

In the aggregating step, a coagulant is added to a dispersion in which at least the polyester resin and the release agent are dispersed to form aggregated particles containing the polyester resin and the release agent.

This step may include, for example, adding a coagulant to a mixed dispersion prepared by mixing the resin particle dispersion, the release agent dispersion, the colorant dispersion, and other dispersions to aggregate the particles in the mixed dispersion, typically with heating, thereby forming aggregated particles.

The aggregated particles are formed by, for example, adding a coagulant to the mixed dispersion at room temperature with stirring using a rotary shear homogenizer to acidify the mixed dispersion and then heating the mixed dispersion to aggregate the particles dispersed in the mixed dispersion.

If the resin particles are made of a crystalline resin such as a crystalline polyester resin, the mixed dispersion is heated to, for example, a temperature around (±20° C.) the melting temperature of the crystalline resin and not higher than the melting temperature.

To inhibit rapid aggregation of the particles due to heating, the pH may be adjusted during stirring at room temperature, and a dispersion stabilizer may be added.

In this exemplary embodiment, the term "room temperature" refers to 25° C.

The coagulant used in the aggregating step may be a surfactant of opposite polarity to the surfactant used as the dispersant added to the raw material dispersions, for example, an inorganic metal salt or a divalent or higher-valent metal complex. In particular, the use of a metal complex may reduce the amount of surfactant used, thus improving the charging characteristics.

Examples of inorganic metal salts that may be used as the coagulant include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. For example, aluminum salts and polymers thereof may be used. To achieve a narrower particle size distribution, inorganic metal salts with higher valences may be used, and for the same valence, inorganic metal salt polymers may be used.

Depositing Step

The aggregating step may be followed by a depositing step. In the depositing step, resin particles may be deposited on the surface of the aggregated particles formed in the aggregating step to form a shell layer (coating layer). Thus, a toner is prepared that has a core-shell structure formed by the core particles and the shell layer covering the core particles.

The shell layer is typically formed by adding a dispersion containing binder resin particles to the dispersion containing the aggregated particles (core particles) formed in the aggregating step. The binder resin used in the depositing step may be the same as or different from the binder resin used in the aggregating step.

The core-shell structure is generally intended to cover core particles containing a release agent and a crystalline resin with a shell layer of an amorphous resin, thereby reducing exposure of the release agent and the crystalline resin contained in the core particles in the surface of the toner. The core-shell structure is also intended to strengthen the core particles if they have insufficient strength.

Coalescing Step

In the coalescing step, for example, after aggregation is terminated by adjusting the pH of the suspension containing the aggregated particles to 6.5 to 8.5, the aggregated particles are coalesced by heating. In this step, the aggregated particles may be coalesced by heating at or above the melting temperature of the resin.

The resin may be crosslinked during heating in the coalescing step or after coalescence is complete. To effect a crosslinking reaction, a crosslinking agent or a polymerization initiator is added for preparation of the toner. The polymerization initiator may be added to the raw material dispersions in advance in the dispersion-preparing step, may be incorporated into the aggregated particles in the aggregating step, or may be incorporated into the particles in or after the coalescing step. If the polymerization initiator is introduced in the aggregating step, in the depositing step, in the coalescing step, or after the coalescing step, a solution or emulsion of the polymerization initiator is added to the dispersion. To control the degree of polymerization, a known additive such as a crosslinking agent, a chain transfer agent, or a polymerization inhibitor may be added to the polymerization initiator.

Subsequent Steps

The coalescing step is followed by, for example, a washing step, a solid-liquid separating step, and a drying step to yield toner particles.

The washing step may be washed by replacement with ion exchange water to achieve high chargeability.

The solid-liquid separating step may be performed by, for example, vacuum filtration or pressure filtration to provide high productivity.

The drying step may be performed by, for example, freeze-drying, flash jet drying, fluidized-bed drying, or vibrating fluidized-bed drying to provide high productivity.

The toner according to this exemplary embodiment is manufactured by, for example, adding an external additive to the resulting dry toner particles and mixing the toner particles. The toner particles may be mixed using, for example, a V-blender, a Henschel mixer, or a Loedige mixer.

The external additive may be added in an amount of 0.1 to 5 parts by mass, preferably 0.3 to 2 parts by mass, per 100 parts by mass of the toner particles.

Optionally, coarse toner particles may be removed using, for example, an ultrasonic separator, a vibrating separator, or a wind separator.

Electrostatic Image Developer

An electrostatic image developer (hereinafter also referred to as "developer") according to an exemplary embodiment contains at least a toner according to an exemplary embodiment.

The developer according to this exemplary embodiment is a one-component developer or a two-component developer. If the developer according to this exemplary embodiment is a two-component developer, the toner is used as a mixture with a carrier.

The carrier used for the two-component developer may be any carrier, and known carriers may be used. Examples of carriers include magnetic metals such as iron, nickel, and cobalt; magnetic oxides such as ferrite and magnetite; resin-coated carriers prepared by coating magnetic metal or oxide cores with a resin coating layer; and resin dispersion carriers prepared by dispersing conductive particles in a matrix resin.

The carrier may be prepared using any coating resin or matrix resin. Examples of coating resins and matrix resins include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins having organosiloxane bonds and modified derivatives thereof, fluoropolymer resins, polyesters, polycarbonates, phenolic resins, epoxy resins, (meth)acrylic resins, and dialkylaminoalkyl (meth)acrylic resins. Among these resins, dialkylaminoalkyl (meth)acrylic resins may be used, for example, to achieve a larger amount of charge.

Examples of conductive materials include metals such as gold, silver, and copper, carbon black, titanium oxide, zinc oxide, tin oxide, barium sulfate, aluminum borate, and potassium titanate.

Examples of materials used for the cores of the carrier include magnetic metals such as iron, nickel, and cobalt; magnetic oxides such as ferrite and magnetite; and glass beads.

The cores of the carrier preferably have a volume average particle size of, for example, 10 to 500 μm, more preferably 30 to 100 μm.

The cores may be coated using a solution for forming the coating layer prepared by dissolving a coating resin and various additives in a suitable solvent.

Specifically, the cores may be coated by dip coating, in which the cores are dipped in the solution for forming the coating layer, by spray coating, in which the solution for forming the coating layer is sprayed onto the cores, by fluidized-bed coating, in which the solution for forming the coating layer is sprayed onto the cores while they are suspended by flowing air, or by kneader coating, in which the cores are mixed with the solution for forming the coating layer in a kneader coater and the solvent is removed thereafter.

The solution for forming the coating layer may be prepared using any solvent. The solvent may be selected depending on considerations such as the type of coating resin used and suitability for coating.

The toner-to-carrier ratio (by mass) of the two-component developer is preferably 1:100 to 30:100, more preferably 3:100 to 20:100.

Image-Forming Apparatus and Method for Forming Image

An image-forming apparatus according to an exemplary embodiment includes an image carrier having a surface, a charging unit that charges the surface of the image carrier, an electrostatic-image forming unit that forms an electrostatic image on the charged surface of the image carrier, a developing unit that develops the electrostatic image formed on the surface of the image carrier with a developer according to an exemplary embodiment to form a toner image, a transfer unit that transfers the toner image to a recording medium, and a fixing unit that fixes the toner image to the recording medium.

The image-forming apparatus according to this exemplary embodiment implements a method for forming an image according to an exemplary embodiment. This method includes charging a surface of an image carrier, forming an electrostatic image on the charged surface of the image carrier, developing the electrostatic image formed on the surface of the image carrier with a developer according to an exemplary embodiment to form a toner image, transferring the toner image to a recording medium, and fixing the toner image to the recording medium.

The image-forming apparatus according to this exemplary embodiment may include a cartridge structure (process cartridge) that is attachable to and detachable from the image-forming apparatus and that includes, for example, the developing unit. The process cartridge may be a process cartridge according to an exemplary embodiment. This process cartridge is attachable to and detachable from an image-forming apparatus and includes a developing unit that contains a developer according to an exemplary embodiment and that develops an electrostatic image formed on a surface of an image carrier with the developer to form a toner image.

A non-limiting example of an image-forming apparatus according to an exemplary embodiment is illustrated below. The relevant parts shown in the drawings are described herein, and a description of other parts is omitted.

FIG. 1 is a schematic view of a four-color tandem image-forming apparatus. The image-forming apparatus illustrated in FIG. 1 includes first, second, third, and fourth electrophotographic image-forming units (image-forming devices) 10Y, 10M, 10C, and 10K that produce yellow (Y), magenta (M), cyan (C), and black (K) images, respectively, based on color-separated image data. The image-forming units (hereinafter also referred to as "units") 10Y, 10M, 10C, and 10K are arranged in parallel at predetermined intervals in the horizontal direction. The units 10Y, 10M, 10C, and 10K may be process cartridges attachable to and detachable from the image-forming apparatus.

An intermediate transfer belt 20, which is an example of an intermediate transfer member, is disposed above the units 10Y, 10M, 100, and 10K so as to pass through each unit. The intermediate transfer belt 20 is entrained about a drive roller 22 and a support roller 24 disposed in contact with the inner surface of the intermediate transfer belt 20 and travels in the direction from the first unit 10Y toward the fourth unit 10K. The support roller 24 is biased in the direction away from the drive roller 22 by, for example, a spring (not shown) so as to apply a predetermined tension to the intermediate transfer belt 20 entrained about the two rollers 22 and 24. An intermediate-transfer-member cleaning device 30 is disposed on the image carrier side of the intermediate transfer belt 20 and opposite the drive roller 22.

The first unit 10Y includes a developing device (developing unit) 4Y to which a yellow toner is supplied from a toner cartridge 8Y. The second unit 10M includes a developing device (developing unit) 4M to which a magenta toner is supplied from a toner cartridge 8M. The third unit 10C includes a developing device (developing unit) 4C to which a cyan toner is supplied from a toner cartridge 8C. The fourth unit 10K includes a developing device (developing unit) 4K to which a black toner is supplied from a toner cartridge 8K.

The first, second, third, and fourth units 10Y, 10M, 10C, and 10K have the same structure; therefore, the description below will concentrate on the first unit 10Y, which forms a yellow image, located upstream in the travel direction of the intermediate transfer belt 20. The parts of the second, third, and fourth units 10M, 10C, and 10K corresponding to those of the first unit 10Y are designated by like numerals followed by "M" (magenta), "C" (cyan), and "K" (black), respectively, instead of "Y" (yellow), and a description thereof is omitted.

The first unit 10Y includes a photoreceptor 1Y that functions as an image carrier. The photoreceptor 1Y is surrounded by, in sequence, a charging roller 2Y, an exposure device 3, the developing device (developing unit) 4Y, a first transfer roller (first transfer unit) 5Y, and a photoreceptor-cleaning device (cleaning unit) 6Y. The charging roller 2Y charges the surface of the photoreceptor 1Y to a predetermined potential. The exposure device 3 exposes the charged surface to a laser beam 3Y based on a color-separated image signal to form an electrostatic image. The developing device 4Y supplies a charged toner to the electrostatic image to develop the electrostatic image. The first transfer roller 5Y transfers the developed image to the intermediate transfer belt 20. The photoreceptor-cleaning device 6Y removes residual toner from the surface of the photoreceptor 1Y after the first transfer.

The first transfer roller 5Y is disposed inside the intermediate transfer belt 20 and opposite the photoreceptor 1Y. A bias power supply (not shown) that applies a first transfer bias is connected to each of the first transfer rollers 5Y, 5M, 5C, and 5K. A controller (not shown) controls the bias power supply to change the transfer bias applied to the first transfer roller.

The yellow-image forming operation of the first unit 10Y will now be described. Prior to the operation, the charging roller 2Y charges the surface of the photoreceptor 1Y to a potential of, for example, about −600 to −800 V.

The photoreceptor 1Y includes a conductive substrate (volume resistivity at 20° C.: $1\times10^{-6}$ Ωcm or less) and a photosensitive layer disposed thereon. The photosensitive layer, which normally has high resistivity (comparable to the resistivities of common resins), has the property of changing its resistivity in the region irradiated with the laser beam 3Y. The exposure device 3 emits the laser beam 3Y based on yellow image data received from the controller (not shown) toward the charged surface of the photoreceptor 1Y. The laser beam 3Y is incident on the photosensitive layer of the photoreceptor 1Y to form an electrostatic image corresponding to a yellow print pattern on the surface of the photoreceptor 1Y.

The electrostatic image is an image formed by the charge on the surface of the photoreceptor 1Y. Specifically, the electrostatic image is a negative latent image formed after the charge on the surface of the photoreceptor 1Y dissipates from the region of the photosensitive layer irradiated with the laser beam 3Y as a result of decreased resistivity while remaining in the region not irradiated with the laser beam 3Y.

As the photoreceptor 1Y rotates, the electrostatic image formed on the photoreceptor 1Y is transported to a predetermined development position, where the electrostatic image on the photoreceptor 1Y is visualized (developed) by the developing device 4Y.

The yellow toner contained in the developing device 4Y is charged by friction as the yellow toner is stirred inside the developing device 4Y. The yellow toner gains a charge of the same polarity (negative) as the charge on the photoreceptor 1Y and is carried on a developer roller (developer carrier). As the surface of the photoreceptor 1Y passes through the developing device 4Y, the yellow toner is electrostatically attracted to the electrostatic image formed on the surface of the photoreceptor 1Y by discharge, thus developing the electrostatic image. The photoreceptor 1Y carrying the yellow toner image continues to rotate at a predetermined speed and transports the toner image to a predetermined first transfer position.

When the yellow toner image on the photoreceptor 1Y reaches the first transfer position, a predetermined first transfer bias is applied to the first transfer roller 5Y. The first transfer bias generates an electrostatic force acting from the photoreceptor 1Y toward the first transfer roller 5Y, thereby transferring the toner image from the photoreceptor 1Y to the intermediate transfer belt 20. The first transfer bias has the opposite polarity (positive) to the toner (negative) and is controlled to, for example, about +10 μA in the first unit 10Y by the controller (not shown).

The cleaning device 6Y removes and collects residual toner from the photoreceptor 1Y.

The first transfer biases applied to the first transfer rollers 5M, 5C, and 5K in the second, third, and fourth units 10M, 10C, and 10K are controlled in the same manner as in the first unit 5Y.

After the yellow toner image is transferred from the first unit 10Y to the intermediate transfer belt 20, the intermediate transfer belt 20 is sequentially transported through the second, third, and fourth units 10M, 10C, and 10K. The second, third, and fourth units 10M, 10C, and 10K form toner images of the respective colors on top of each other, thus forming a combined toner image.

After the toner images of the four colors are combined on the intermediate transfer belt 20 through the first, second, third, and fourth units 10Y, 10M, 10C, and 10K, the intermediate transfer belt 20 reaches a second transfer section. The second transfer section includes the intermediate transfer belt 20, the support roller 24 disposed in contact with the inner surface of the intermediate transfer belt 20, and a second transfer roller (second transfer unit) 26 disposed on the image carrier side of the intermediate transfer belt 20. At the same time, recording paper (recording medium) P is fed into a nip between the second transfer roller 26 and the intermediate transfer belt 20 at a predetermined timing by a feed mechanism. A predetermined second transfer bias is then applied to the support roller 24. The second transfer bias has the same polarity (negative) as the toner (negative). The second transfer bias generates an electrostatic force acting from the intermediate transfer belt 20 toward the recording paper P, thereby transferring the combined toner image from the intermediate transfer belt 20 to the recording paper P. The second transfer bias is set depending on the resistance detected by a resistance detector (not shown) that detects the resistance of the second transfer section, and the voltage is controlled accordingly.

Thereafter, the recording paper P is fed to a fixing device (fixing unit) 28. The fixing device 28 heats the combined toner image to melt and fix the combined toner image to the recording paper P. After the color image is fixed, the recording paper P is transported toward an output section by transport rollers (output rollers) 32. Thus, the color-image forming operation is completed.

Although the illustrated image-forming apparatus is configured to transfer the toner images to the recording paper P via the intermediate transfer belt 20, it may be configured in other manners. For example, the image-forming apparatus may be configured to directly transfer the toner images from the photoreceptors 1Y, 1M, 1C, and 1K to the recording paper P.

Process Cartridge and Toner Cartridge

Figure 2:
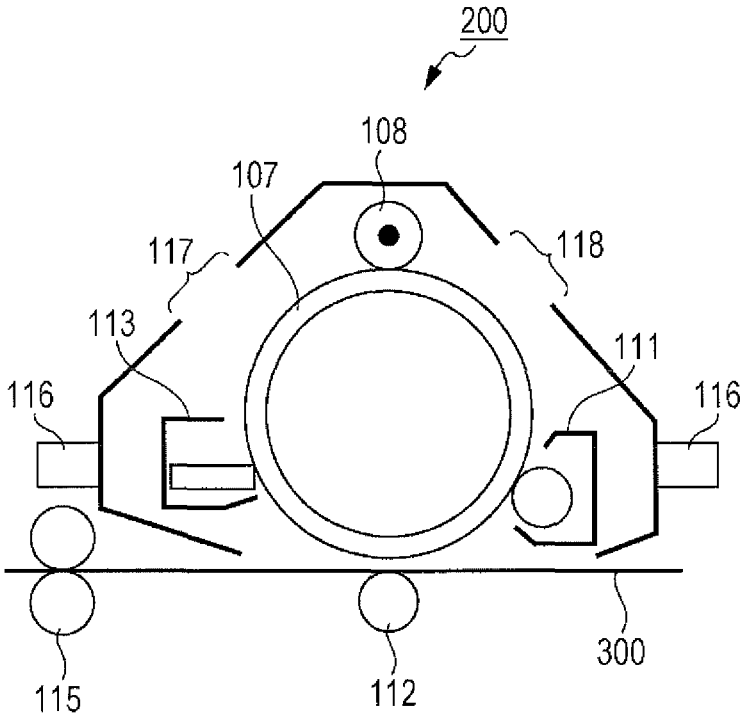
FIG. 2 is a schematic view of an example of a process cartridge according to an exemplary embodiment.

FIG. 2 is a schematic view of a process cartridge containing an electrostatic image developer according to an exemplary embodiment. A process cartridge 200 includes a photoreceptor 107, a charging device 108, a developing device 111, a photoreceptor-cleaning device (cleaning unit) 113, an exposure opening 118, and an erase exposure opening 117. These devices are mounted and assembled on a mounting rail 116.

The process cartridge 200 is attachable to and detachable from an image-forming apparatus including a transfer device 112, a fixing device 115, and other components (not shown) and forms part of the image-forming apparatus. Recording paper 300 is also illustrated.

Although the process cartridge 200 illustrated in FIG. 2 includes the photoreceptor 107, the charging device 108, the developing device 111, the photoreceptor-cleaning device 113, the exposure opening 118, and the erase exposure opening 117, they may be selected in any combination. A process cartridge according to an exemplary embodiment may include the developing device 111 and at least one selected from the group consisting of the photoreceptor 107, the charging device 108, the photoreceptor-cleaning device 113, the exposure opening 118, and the erase exposure opening 117.

Next, a toner cartridge according to an exemplary embodiment will be described.

The toner cartridge according to this exemplary embodiment is attachable to and detachable from an image-forming apparatus and contains at least a toner according to an exemplary embodiment to be supplied to a developing unit disposed in the image-forming apparatus. The toner cartridge, which contains at least the toner, may contain, for example, a developer, depending on the mechanism of the image-forming apparatus.

The image-forming apparatus illustrated in FIG. 1 includes the toner cartridges 8Y, 8M, 8C, and 8K, which are attachable thereto and detachable therefrom. The developing devices 4Y, 4M, 4C, and 4K are connected to the toner cartridges 8Y, 8M, 8C, and 8K, respectively, via toner supply tubes (not shown). The toner cartridges 8Y, 8M, 8C, and 8K are replaced when the toner level is low.

EXAMPLES

Exemplary embodiments will now be specifically described with reference to the Examples and Comparative Examples below, although the exemplary embodiments are not limited thereto.

Parts and percentages are by mass unless otherwise indicated.

The measurement procedures used in the Examples and Comparative Examples are as follows.

Procedures for Measuring Various Properties

Measurement of Molecular Weight of Resin

The molecular weight is measured by GPC.

Measurement system: HLC-8120GPC, SC-8020 (available from Tosoh Corporation)

Columns: TSKgel SuperHM-H (6.0 mm ID×15 cm, 2 columns) (available from Tosoh Corporation)

Eluent: tetrahydrofuran (THF)

Measurement conditions: sample concentration: 0.5%, flow rate: 0.6 mL/min, sample injection volume: 10 μL, measurement temperature: 40° C., detector: refractive index (RI) detector. A calibration curve is prepared with the following ten samples: TSK Polystyrene Standards A-500, F-1, F-10, F-80, F-380, A-2500, F-4, F-40, F-128, and F-700 (available from Tosoh Corporation).

Measurement of Melting Temperature and Glass Transition Temperature of Resin

The melting temperature and the glass transition temperature are determined by DSC. Specifically, the melting temperature and the glass transition temperature are determined from a main maximum peak measured according to ASTM D3418-8.

The main maximum peak is measured using DSC-7 available from PerkinElmer Inc. The temperature calibration of the detector in the system is performed with respect to the melting temperatures of indium and zinc, and the heat capacity calibration is performed with respect to the heat of fusion of indium. A sample is placed on an aluminum pan, and an empty pan is also set as a reference. A measurement is performed at a heating rate of 10° C./min.

Measurement of Acid Value

In 80 mL of THF, 1 g of a resin is weighed and dissolved. After phenolphthalein is added as an indicator, the solution is titrated with a 0.1 N potassium hydroxide solution in ethanol. The titration is terminated when the indicator retains its color for 30 seconds. The amount of 0.1 N potassium hydroxide solution added is used to calculate the acid value (the amount (mg) of KOH used to neutralize free fatty acid contained in 1 g of the resin) (according to JIS K0070:92).

Measurement of Particle Size and Particle Size Distribution

The particle size and the particle size distribution are measured as follows.

Particle Sizes of 2 μm or More

Measurement sample: a measurement sample is prepared by adding 0.5 to 50 mg of particles in 2 mL of a 5% sodium alkylbenzenesulfonate (surfactant) aqueous solution, adding the solution to 100 mL of an electrolyte solution (ISOTON II available from Beckman Coulter, Inc.), and dispersing the particles using an ultrasonic disperser for one minute.

Measurement system: Coulter Multisizer II (available from Beckman Coulter, Inc.), aperture diameter: 100 μm The above measurement sample and system are used to measure the particle sizes of 50,000 particles 2 to 60 μm in size. The resulting particle size distribution is used to determine the volume and number average particle size distributions.

The volume average particle size and the volume average geometric size distribution are determined as follows.

Based on the particle size distribution, a cumulative volume distribution is generated from smaller particle size ranges (channels). The particle size D16v is defined as the particle size for a cumulative volume of 16%. The particle size D50v is defined as the particle size for a cumulative volume of 50%. The particle size D84v is defined as the particle size for a cumulative volume of 84%. The particle size D50v is used as the volume average particle size. The volume average geometric size distribution GSDv is calculated by the following equation:

$$GSDv=(D84v/D16v)^{1/2}$$

Particle Sizes of Less than 2 μm

Measurement sample: a measurement sample is prepared by adding ion exchange water to 2 g (solid content) of particle dispersion to a volume of 40 mL, and for powders such as external additives, a measurement sample is prepared by adding 2 g of powder to 50 mL of a 5% sodium alkylbenzenesulfonate aqueous solution and dispersing the powder using an ultrasonic disperser (1,000 Hz)) for two minutes.

Measurement system: laser diffraction particle size distribution analyzer (LA-920 from Horiba, Ltd.)

The measurement sample is charged into a cell to a suitable concentration. After two minutes, a measurement is performed when the concentration in the cell becomes stable. The volume average particle size is determined as the particle size for a cumulative volume of 50% in a cumulative volume distribution generated from channels of smaller particle sizes.

Measurement of Shape Factor SF1 of Toner

A light micrograph of toner particles dispersed over a glass slide is captured using a video camera and is fed to a LUZEX image analyzer. The shape factors SF1 of 50 toner particles are calculated and averaged.

Synthesis of Amorphous Polyester Resin and Preparation of Amorphous Resin Particle Dispersion Amorphous Polyester Resin (1)

Dehydroabietic acid derivative DHA (1) is synthesized by the following procedure.

Dehydroabietic acid (75 g) and succinic anhydride (38 g) are dissolved in methylene chloride (1 L), and anhydrous aluminum chloride (130 g) is added in small fractions under ice cooling. Following stirring at 10° C. to 15° C. for 2 hours, the reaction solution is poured into ice water. The resulting white crystals are filtered, are washed with water, and are washed with methanol to yield dehydroabietic acid derivative DHA (1) (72 g) represented by the following structural formula:

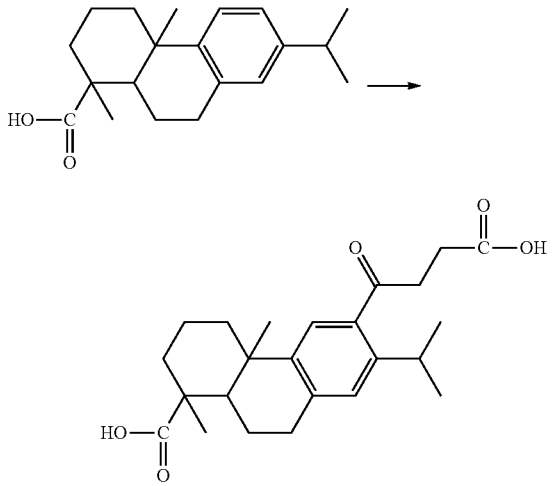

DHA (1)

| | |
|---|---|
| Propylene glycol | 100 parts by mole |
| Dehydroabietic acid derivative DHA (1) | 10 parts by mole |

-continued

| | |
|---|---|
| Terephthalic acid | 90 parts by mole |
| Dibutyltin oxide (catalyst) | 0.05 part by mole per 100 parts by mole of total amount of acid components |

The above materials are charged to a three-necked flask dried by heating. After the flask is purged with nitrogen gas so that an inert atmosphere is maintained therein, the mixture is heated to allow a copolycondensation reaction to proceed at 150° C. to 230° C. for 16 hours. Thereafter, the pressure is gradually reduced at 210° C. to 250° C. In this manner, amorphous polyester resin (1) is yielded, which has a weight average molecular weight (Mw) of 59,000 and a number average molecular weight (Mn) of 8,500.

The melting temperature (Tm) of amorphous polyester resin (1) is measured by DSC. The measurement results show no clear peak, but instead a stepwise change in the amount of heat absorbed. The glass transition temperature determined as the midpoint of the stepwise change in the amount of heat absorbed is 50° C.

To an emulsifying tank of an emulsifying system (Cavitron CD1010, slit size: 0.4 mm) are charged 3,000 parts of amorphous polyester resin (1), 10,000 parts of ion exchange water, and 100 parts of sodium dodecylbenzenesulfonate as a dispersant. The resin is melted by heating at 130° C. and is dispersed at 110° C. and 10,000 rpm for 30 minutes. The resulting dispersion is passed through a cooling tank at a flow rate of 3 L/min and is collected to yield amorphous polyester resin particle dispersion (1) with a solid content of 20.0%. The particles contained in amorphous polyester resin particle dispersion (1) have a volume average particle size D50v of 0.25 μm.

Amorphous Polyester Resin (2)

Dehydroabietic acid derivative DHA (2) is synthesized by the following procedure.

Sulfuric acid (30 mL) is added dropwise to acetic acid (100 mL) under ice cooling. Dehydroabietic acid (available from Arakawa Chemical Industries, Ltd., 30.0 g) and paraformaldehyde (2.1 g) are then added at room temperature, and the solution is stirred at 40° C. for 3 hours. The reaction solution is poured into ice water (1 L) and is extracted with ethyl acetate. The extract is washed with water until the washing liquid becomes nearly neutral, is dried over anhydrous magnesium sulfate, and is distilled under reduced pressure to remove the solvent. To the residue, 80 mL of methanol is added, and the resulting white crystals are filtered and dried to yield dehydroabietic acid derivative DHA (2) (19.8 g) represented by the following structural formula:

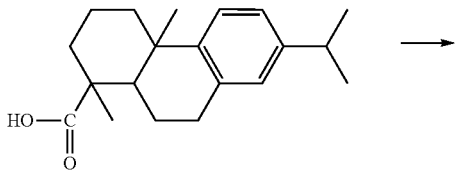

-continued

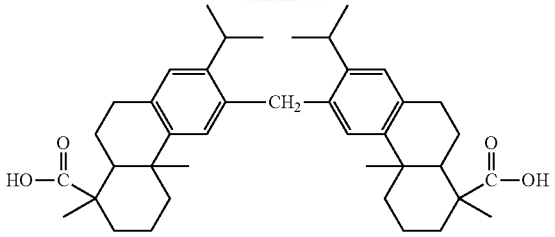

DHA (2)

Amorphous polyester resin (2) is synthesized in the same manner as amorphous polyester resin (1) except that dehydroabietic acid derivative DHA (1) is replaced by dehydroabietic acid derivative DHA (2). Amorphous polyester resin (2) has a weight average molecular weight (Mw) of 62,000 and a number average molecular weight (Mn) of 9,000.

The melting temperature (Tm) of amorphous polyester resin (2) is measured by DSC. The measurement results show no clear peak, but instead a stepwise change in the amount of heat absorbed. The glass transition temperature determined as the midpoint of the stepwise change in the amount of heat absorbed is 57° C.

Amorphous polyester resin particle dispersion (2) with a solid content of 20.0% is prepared in the same manner as amorphous polyester resin particle dispersion (1). The particles contained in amorphous polyester resin particle dispersion (2) have a volume average particle size D50v of 0.26 μm.

Amorphous Polyester Resin (3)

Amorphous polyester resin (3) is synthesized in the same manner as amorphous polyester resin (2) except that the pressure is gradually reduced over a longer period of time. Amorphous polyester resin (3) has a weight average molecular weight (Mw) of 80,000 and a number average molecular weight (Mn) of 12,000.

The melting temperature (Tm) of amorphous polyester resin (3) is measured by DSC. The measurement results show no clear peak, but instead a stepwise change in the amount of heat absorbed. The glass transition temperature determined as the midpoint of the stepwise change in the amount of heat absorbed is 60° C.

Amorphous polyester resin particle dispersion (3) with a solid content of 20.0% is prepared in the same manner as amorphous polyester resin particle dispersion (1). The particles contained in amorphous polyester resin particle dispersion (3) have a volume average particle size D50v of 0.24 μm.

Amorphous Polyester Resin (4)

Amorphous polyester resin (4) is synthesized in the same manner as amorphous polyester resin (2) except that the pressure is gradually reduced over a shorter period of time. Amorphous polyester resin (4) has a weight average molecular weight (Mw) of 40,000 and a number average molecular weight (Mn) of 6,500.

The melting temperature (Tm) of amorphous polyester resin (4) is measured by DSC. The measurement results show no clear peak, but instead a stepwise change in the amount of heat absorbed. The glass transition temperature determined as the midpoint of the stepwise change in the amount of heat absorbed is 54° C.

Amorphous polyester resin particle dispersion (4) with a solid content of 20.0% is prepared in the same manner as amorphous polyester resin particle dispersion (1). The particles contained in amorphous polyester resin particle dispersion (4) have a volume average particle size D50v of 0.24 μm.

Amorphous Polyester Resin (5)

Amorphous polyester resin (5) is synthesized in the same manner as amorphous polyester resin (2) except that the pressure is gradually reduced over a shorter period of time. Amorphous polyester resin (5) has a weight average molecular weight (Mw) of 55,000 and a number average molecular weight (Mn) of 6,100.

The melting temperature (Tm) of amorphous polyester resin (5) is measured by DSC. The measurement results show no clear peak, but instead a stepwise change in the amount of heat absorbed. The glass transition temperature determined as the midpoint of the stepwise change in the amount of heat absorbed is 55° C.

Amorphous polyester resin particle dispersion (5) with a solid content of 20.0% is prepared in the same manner as amorphous polyester resin particle dispersion (1). The particles contained in amorphous polyester resin particle dispersion (5) have a volume average particle size D50v of 0.19 μm.

Amorphous Polyester Resin (6)

Amorphous polyester resin (6) is synthesized in the same manner as amorphous polyester resin (2) except that the pressure is gradually reduced over a shorter period of time. Amorphous polyester resin (6) has a weight average molecular weight (Mw) of 69,000 and a number average molecular weight (Mn) of 4,300.

The melting temperature (Tm) of amorphous polyester resin (6) is measured by DSC. The measurement results show no clear peak, but instead a stepwise change in the amount of heat absorbed. The glass transition temperature determined as the midpoint of the stepwise change in the amount of heat absorbed is 57.5° C.

Amorphous polyester resin particle dispersion (6) with a solid content of 20.0% is prepared in the same manner as amorphous polyester resin particle dispersion (1). The particles contained in amorphous polyester resin particle dispersion (6) have a volume average particle size D50v of 0.21 μm.

Amorphous Polyester Resin (7)

Amorphous polyester resin (7) is synthesized in the same manner as amorphous polyester resin (2) except that the pressure is gradually reduced over a shorter period of time. Amorphous polyester resin (7) has a weight average molecular weight (Mw) of 80,000 and a number average molecular weight (Mn) of 4,100.

The melting temperature (Tm) of amorphous polyester resin (7) is measured by DSC. The measurement results show no clear peak, but instead a stepwise change in the amount of heat absorbed. The glass transition temperature determined as the midpoint of the stepwise change in the amount of heat absorbed is 59° C.

Amorphous polyester resin particle dispersion (7) with a solid content of 20.0% is prepared in the same manner as amorphous polyester resin particle dispersion (1). The particles contained in amorphous polyester resin particle dispersion (7) have a volume average particle size D50v of 0.22 μm.

Amorphous Polyester Resin (8)

Amorphous polyester resin (8) is synthesized in the same manner as amorphous polyester resin (2) except that terephthalic acid is added in an amount of 80 parts by mole, rather than 90 parts by mole, and dodecenylsuccinic acid is added in an amount of 10 parts by mole. Amorphous polyester resin (8) has a weight average molecular weight (Mw) of 73,000 and a number average molecular weight (Mn) of 8,000.

The melting temperature (Tm) of amorphous polyester resin (8) is measured by DSC. The measurement results show no clear peak, but instead a stepwise change in the amount of heat absorbed. The glass transition temperature determined as the midpoint of the stepwise change in the amount of heat absorbed is 54° C.

Amorphous polyester resin particle dispersion (8) with a solid content of 20.0% is prepared in the same manner as amorphous polyester resin particle dispersion (1). The particles contained in amorphous polyester resin particle dispersion (8) have a volume average particle size D50v of 0.26 μm.

Amorphous Polyester Resin (9)

Amorphous polyester resin (9) is synthesized in the same manner as amorphous polyester resin (2) except that terephthalic acid is added in an amount of 80 parts by mole, rather than 90 parts by mole, and butenylsuccinic acid is added in an amount of 10 parts by mole. Amorphous polyester resin (9) has a weight average molecular weight (Mw) of 65,000 and a number average molecular weight (Mn) of 8,800.

The melting temperature (Tm) of amorphous polyester resin (9) is measured by DSC. The measurement results show no clear peak, but instead a stepwise change in the amount of heat absorbed. The glass transition temperature determined as the midpoint of the stepwise change in the amount of heat absorbed is 56° C.

Amorphous polyester resin particle dispersion (9) with a solid content of 20.0% is prepared in the same manner as amorphous polyester resin particle dispersion (1). The particles contained in amorphous polyester resin particle dispersion (9) have a volume average particle size D50v of 0.24 μm.

Amorphous Polyester Resin (10)

Amorphous polyester resin (10) is synthesized in the same manner as amorphous polyester resin (2) except that terephthalic acid is added in an amount of 80 parts by mole, rather than 90 parts by mole, and hexadecylsuccinic acid is added in an amount of 10 parts by mole. Amorphous polyester resin (10) has a weight average molecular weight (Mw) of 71,000 and a number average molecular weight (Mn) of 9,500.

The melting temperature (Tm) of amorphous polyester resin (10) is measured by DSC. The measurement results show no clear peak, but instead a stepwise change in the amount of heat absorbed. The glass transition temperature determined as the midpoint of the stepwise change in the amount of heat absorbed is 53.5° C.

Amorphous polyester resin particle dispersion (10) with a solid content of 20.0% is prepared in the same manner as amorphous polyester resin particle dispersion (1). The particles contained in amorphous polyester resin particle dispersion (10) have a volume average particle size D50v of 0.2 μm.

Amorphous Polyester Resin (C1)

Amorphous polyester resin (C1) is synthesized in the same manner as amorphous polyester resin (2) except that the pressure is gradually reduced over a shorter period of time. Amorphous polyester resin (C1) has a weight average molecular weight (Mw) of 20,000 and a number average molecular weight (Mn) of 4,000.

The melting temperature (Tm) of amorphous polyester resin (C1) is measured by DSC. The measurement results show no clear peak, but instead a stepwise change in the amount of heat absorbed. The glass transition temperature determined as the midpoint of the stepwise change in the amount of heat absorbed is 54° C.

Amorphous polyester resin particle dispersion (C1) with a solid content of 20.0% is prepared in the same manner as amorphous polyester resin particle dispersion (1). The particles contained in amorphous polyester resin particle dispersion (C1) have a volume average particle size D50v of 0.24 μm.

Amorphous Polyester Resin (C2)

Amorphous polyester resin (C2) is synthesized in the same manner as amorphous polyester resin (2) except that the pressure is gradually reduced over a longer period of time. Amorphous polyester resin (C2) has a weight average molecular weight (Mw) of 100,000 and a number average molecular weight (Mn) of 8,500.

The melting temperature (Tm) of amorphous polyester resin (C2) is measured by DSC. The measurement results show no clear peak, but instead a stepwise change in the amount of heat absorbed. The glass transition temperature determined as the midpoint of the stepwise change in the amount of heat absorbed is 63° C.

Amorphous polyester resin particle dispersion (C2) with a solid content of 20.0% is prepared in the same manner as amorphous polyester resin particle dispersion (1). The particles contained in amorphous polyester resin particle dispersion (C2) have a volume average particle size D50v of 0.27 μm.

The compositions and properties of the amorphous polyester resins are summarized in Table 1.

TABLE 1

| Polymerization component | | Number of carbon atoms in linear side chain | Amorphous polyester resin (1) | (2) | (3) | (4) | (5) | (6) | (7) |
|---|---|---|---|---|---|---|---|---|---|
| Dicarboxylic acid | DHA (1) | 1 | 10 | — | — | — | — | — | — |
| | DHA (2) | 1 | — | 10 | 10 | 10 | 10 | 10 | 10 |
| | Terephthalic acid | 0 | 90 | 90 | 90 | 90 | 90 | 90 | 90 |
| | Dodecenylsuccinic acid | 12 | — | — | — | — | — | — | — |
| | Butenylsuccinic acid | 4 | — | — | — | — | — | — | — |
| | Hexadecylsuccinic acid | 16 | — | — | — | — | — | — | — |
| Diol | Propylene glycol | 1 | 100 | 100 | 100 | 100 | 100 | 100 | 100 |
| Weight average molecular weight (Mw) | | | 59000 | 62000 | 80000 | 40000 | 55000 | 69000 | 80000 |
| Number average molecular weight (Mn) | | | 8500 | 9000 | 12000 | 6500 | 6100 | 4300 | 4100 |
| Molecular weight distribution (Mw/Mn) | | | 6.9 | 6.9 | 6.7 | 6.2 | 9.0 | 16.0 | 19.5 |
| Glass transition temperature (° C.) | | | 50 | 57 | 60 | 54 | 55 | 57.5 | 59 |
| Acid value (mgKOH/g) | | | 13 | 11.5 | 8.5 | 14.5 | 12.5 | 13.5 | 14.5 |

TABLE 1-continued

| Polymerization component | | Number of carbon atoms in linear side chain | Amorphous polyester resin (8) | (9) | (10) | (C1) | (C2) |
|---|---|---|---|---|---|---|---|
| Dicarboxylic acid | DHA (1) | 1 | — | — | — | — | — |
| | DHA (2) | 1 | 10 | 10 | 10 | 10 | 10 |
| | Terephthalic acid | 0 | 80 | 80 | 80 | 90 | 90- |
| | Dodecenylsuccinic acid | 12 | 10 | — | — | — | — |
| | Butenylsuccinic acid | 4 | — | 10 | — | — | — |
| | Hexadecylsuccinic acid | 16 | — | — | 10 | — | — |
| Diol | Propylene glycol | 1 | 100 | 100 | 100 | 100 | 100 |
| Weight average molecular weight (Mw) | | | 73000 | 65000 | 71000 | 20000 | 100000 |
| Number average molecular weight (Mn) | | | 8000 | 8800 | 9500 | 4000 | 8500 |
| Molecular weight distribution (Mw/Mn) | | | 9.1 | 7.4 | 7.5 | 5.0 | 11.8 |
| Glass transition temperature (° C.) | | | 54 | 56 | 53.5 | 54 | 63 |
| Acid value (mgKOH/g) | | | 13.5 | 12 | 12.5 | 16.5 | 7.3 |

Synthesis of Crystalline Polyester Resin and Preparation of Crystalline Resin Particle Dispersion Crystalline Polyester Resin (1)

| | |
|---|---|
| n-Dodecanedioic acid | 100 parts by mole |
| 1,9-Nonanediol | 100 parts by mole |
| Dibutyltin oxide (catalyst) | 0.3 part by mole per 100 parts by mole of total amount of n-dodecanedioic acid and 1,9-nonanediol |

The above materials are charged to a three-necked flask dried by heating. After the flask is purged with nitrogen gas by reducing the pressure so that an inert atmosphere is maintained therein, the mixture is stirred at 180° C. for 2 hours. Thereafter, the mixture is gradually heated to 200° C. under reduced pressure and is stirred for 2 hours. When the mixture becomes viscous, the mixture is allowed to cool in air to terminate the reaction. In this manner, crystalline polyester resin (1) is yielded, which has a weight average molecular weight (Mw) of 5,800 and a number average molecular weight (Mn) of 2,800.

The melting temperature (Tm) of crystalline polyester resin (1) is measured by DSC. The measurement results show a clear peak with a peak top temperature of 70.5° C.

To an emulsifying tank of an emulsifying system (Cavitron CD1010, slit size: 0.4 mm) are charged 3,000 parts of crystalline polyester resin (1), 10,000 parts of ion exchange water, and 100 parts of sodium dodecylbenzenesulfonate as a dispersant. The resin is melted by heating at 130° C. and is dispersed at 110° C. and 10,000 rpm for 30 minutes. The resulting dispersion is passed through a cooling tank at a flow rate of 3 L/min and is collected to yield crystalline polyester resin particle dispersion (1) with a solid content of 20.0%. The particles contained in crystalline polyester resin particle dispersion (1) have a volume average particle size D50v of 0.25 μm.

Crystalline Polyester Resin (2)

Crystalline polyester resin (2) is synthesized in the same manner as crystalline polyester resin (1) except that n-dodecanedioic acid is replaced by n-undecanedioic acid, and 1,9-nonanediol is replaced by 1,10-decanediol. Crystalline polyester resin (2) has a weight average molecular weight (Mw) of 6,300 and a number average molecular weight (Mn) of 2,850.

The melting temperature (Tm) of crystalline polyester resin (2) is measured by DSC. The measurement results show a clear peak with a peak top temperature of 69.5° C.

Crystalline polyester resin particle dispersion (2) with a solid content of 20.0% is prepared in the same manner as crystalline polyester resin particle dispersion (1). The particles contained in crystalline polyester resin particle dispersion (2) have a volume average particle size D50v of 0.22 μm.

Crystalline Polyester Resin (3)

Crystalline polyester resin (3) is synthesized in the same manner as crystalline polyester resin (1) except that 1,9-nonanediol is replaced by 1,6-hexanediol. Crystalline polyester resin (3) has a weight average molecular weight (Mw) of 5,700 and a number average molecular weight (Mn) of 2,700.

The melting temperature (Tm) of crystalline polyester resin (3) is measured by DSC. The measurement results show a clear peak with a peak top temperature of 73° C.

Crystalline polyester resin particle dispersion (3) with a solid content of 20.0% is prepared in the same manner as crystalline polyester resin particle dispersion (1). The particles contained in crystalline polyester resin particle dispersion (3) have a volume average particle size D50v of 0.24 μm.

Crystalline Polyester Resin (4)

Crystalline polyester resin (4) is synthesized in the same manner as crystalline polyester resin (1) except that n-dodecanedioic acid is replaced by suberic acid, and 1,9-nonanediol is replaced by 1,10-decanediol. Crystalline polyester resin (4) has a weight average molecular weight (Mw) of 5,900 and a number average molecular weight (Mn) of 2,800.

The melting temperature (Tm) of crystalline polyester resin (4) is measured by DSC. The measurement results show a clear peak with a peak top temperature of 75° C.

Crystalline polyester resin particle dispersion (4) with a solid content of 20.0% is prepared in the same manner as crystalline polyester resin particle dispersion (1). The particles contained in crystalline polyester resin particle dispersion (4) have a volume average particle size D50v of 0.21 μm.

Crystalline Polyester Resin (5)

Crystalline polyester resin (5) is synthesized in the same manner as crystalline polyester resin (1) except that n-dodecanedioic acid is replaced by suberic acid, and 1,9-nonanediol is replaced by 1,6-hexanediol. Crystalline polyester resin (5) has a weight average molecular weight (Mw) of 6,200 and a number average molecular weight (Mn) of 3,100.

The melting temperature (Tm) of crystalline polyester resin (5) is measured by DSC. The measurement results show a clear peak with a peak top temperature of 76.5° C.

Crystalline polyester resin particle dispersion (5) with a solid content of 20.0% is prepared in the same manner as crystalline polyester resin particle dispersion (1). The particles contained in crystalline polyester resin particle dispersion (5) have a volume average particle size D50v of 0.19 μm.

Crystalline Polyester Resin (6)

Crystalline polyester resin (6) is synthesized in the same manner as crystalline polyester resin (1) except that n-dodecanedioic acid is replaced by sebacic acid, and 1,9-nonanediol is replaced by 1,6-hexanediol. Crystalline polyester resin (6) has a weight average molecular weight (Mw) of 6,000 and a number average molecular weight (Mn) of 2,900.

The melting temperature (Tm) of crystalline polyester resin (6) is measured by DSC. The measurement results show a clear peak with a peak top temperature of 74.5° C.

Crystalline polyester resin particle dispersion (6) with a solid content of 20.0% is prepared in the same manner as crystalline polyester resin particle dispersion (1). The particles contained in crystalline polyester resin particle dispersion (6) have a volume average particle size D50v of 0.22 μm.

Crystalline Polyester Resin (7)

Crystalline polyester resin (7) is synthesized in the same manner as crystalline polyester resin (1) except that n-dodecanedioic acid is replaced by sebacic acid. Crystalline polyester resin (7) has a weight average molecular weight (Mw) of 5,900 and a number average molecular weight (Mn) of 3,000.

The melting temperature (Tm) of crystalline polyester resin (7) is measured by DSC. The measurement results show a clear peak with a peak top temperature of 74° C.

Crystalline polyester resin particle dispersion (7) with a solid content of 20.0% is prepared in the same manner as crystalline polyester resin particle dispersion (1). The particles contained in crystalline polyester resin particle dispersion (7) have a volume average particle size D50v of 0.2 μm.

Crystalline Polyester Resin (8)

Crystalline polyester resin (8) is synthesized in the same manner as crystalline polyester resin (1) except that n-dodecanedioic acid is replaced by sebacic acid, and 1,9-nonanediol is replaced by 1,10-decanediol. Crystalline polyester resin (8) has a weight average molecular weight (Mw) of 6,000 and a number average molecular weight (Mn) of 2850.

The melting temperature (Tm) of crystalline polyester resin (8) is measured by DSC. The measurement results show a clear peak with a peak top temperature of 73° C.

Crystalline polyester resin particle dispersion (8) with a solid content of 20.0% is prepared in the same manner as crystalline polyester resin particle dispersion (1). The particles contained in crystalline polyester resin particle dispersion (8) have a volume average particle size D50v of 0.18 μm.

Crystalline Polyester Resin (C1)

Crystalline polyester resin (C1) is synthesized in the same manner as crystalline polyester resin (1) except that 1,9-nonanediol is replaced by 1,10-decanediol. Crystalline polyester resin (C1) has a weight average molecular weight (Mw) of 6,200 and a number average molecular weight (Mn) of 3,000.

The melting temperature (Tm) of crystalline polyester resin (C1) is measured by DSC. The measurement results show a clear peak with a peak top temperature of 69° C.

Crystalline polyester resin particle dispersion (C1) with a solid content of 20.0% is prepared in the same manner as crystalline polyester resin particle dispersion (1). The particles contained in crystalline polyester resin particle dispersion (C1) have a volume average particle size D50v of 0.25 μm.

Crystalline Polyester Resin (C2)

Crystalline polyester resin (C2) is synthesized in the same manner as crystalline polyester resin (1) except that 1,9-nonanediol is replaced by 1,5-pentanediol. Crystalline polyester resin (C2) has a weight average molecular weight (Mw) of 6,100 and a number average molecular weight (Mn) of 3,050.

The melting temperature (Tm) of crystalline polyester resin (C2) is measured by DSC. The measurement results show a clear peak with a peak top temperature of 75° C.

Crystalline polyester resin particle dispersion (C2) with a solid content of 20.0% is prepared in the same manner as crystalline polyester resin particle dispersion (1). The particles contained in crystalline polyester resin particle dispersion (C2) have a volume average particle size D50v of 0.23 μm.

Crystalline Polyester Resin (C3)

Crystalline polyester resin (C3) is synthesized in the same manner as crystalline polyester resin (1) except that n-dodecanedioic acid is replaced by pimelic acid, and 1,9-nonanediol is replaced by 1,10-decanediol. Crystalline polyester resin (C3) has a weight average molecular weight (Mw) of 5,950 and a number average molecular weight (Mn) of 2,950.

The melting temperature (Tm) of crystalline polyester resin (C3) is measured by DSC. The measurement results show a clear peak with a peak top temperature of 74.5° C.

Crystalline polyester resin particle dispersion (C3) with a solid content of 20.0% is prepared in the same manner as crystalline polyester resin particle dispersion (1). The particles contained in crystalline polyester resin particle dispersion (C3) have a volume average particle size D50v of 0.2 μm.

The compositions and properties of the crystalline polyester resins are summarized in Table 2.

TABLE 2

| Polymerization component | | Number of carbon atoms | Crystalline polyester resin (1) | (2) | (3) | (4) | (5) | (6) | (7) | (8) | (C1) | (C2) | (C3) |
|---|---|---|---|---|---|---|---|---|---|---|---|---|---|
| Dicarboxylic acid | Pimelic acid | 5 | — | — | — | — | — | — | — | — | — | — | 100 |
| | Suberic acid | 6 | — | — | — | 100 | 100 | — | — | — | — | — | — |
| | Sebacic acid | 8 | — | — | — | — | — | 100 | 100 | 100 | — | — | — |
| | n-Undecanedioic acid | 9 | — | 100 | — | — | — | — | — | — | — | — | — |
| | n-Dodecanedioic acid | 10 | 100 | — | 100 | — | — | — | — | — | 100 | 100 | — |
| Diol | 1,5-Pentanediol | 5 | — | — | — | — | — | — | — | — | — | 100 | — |
| | 1,6-Hexanediol | 6 | — | — | 100 | — | 100 | 100 | — | — | — | — | — |
| | 1,9-Nonanediol | 9 | 100 | — | — | — | — | — | 100 | — | — | — | — |
| | 1,10-Decanediol | 10 | — | 100 | — | 100 | — | — | — | 100 | 100 | — | 100 |
| Weight average molecular weight (Mw) | | | 5800 | 6300 | 5700 | 5900 | 6200 | 6000 | 5900 | 6000 | 6200 | 6100 | 5950 |

TABLE 2-continued

| Polymerization component | Number of carbon atoms | Crystalline polyester resin (1) | (2) | (3) | (4) | (5) | (6) | (7) | (8) | (C1) | (C2) | (C3) |
|---|---|---|---|---|---|---|---|---|---|---|---|---|
| Number average molecular weight (Mn) | | 2800 | 2850 | 2700 | 2800 | 3100 | 2900 | 3000 | 2850 | 3000 | 3050 | 2950 |
| Melting temperature (° C.) | | 70.5 | 69.5 | 73 | 75 | 76.5 | 74.5 | 74 | 73 | 69 | 75 | 74.5 |
| Acid value (mgKOH/g) | | 11 | 12 | 11 | 13 | 12.5 | 12 | 10 | 9.5 | 12 | 14 | 13 |

Preparation of Release Agent Particle Dispersion

| | |
|---|---|
| Paraffin wax (HNPO190 available from Nippon Seiro Co., Ltd., melting point: 85° C.) | 46 parts |
| Anionic surfactant (DOWFAX available from Dow Chemical Company) | 4 parts |
| Ion exchange water | 200 parts |

The above materials are mixed and heated to 96° C. The mixture is dispersed at 3,000 rpm using a homogenizer (Ultra-Turrax T50 available from IKA) for 1 hour and is then dispersed using a pressure discharge homogenizer (available from Gaulin) to yield a release agent dispersion with a volume average particle size of 160 nm and a solid content of 20.0%.

Preparation of Colorant Particle Dispersion

| | |
|---|---|
| Cyan pigment (PB15:3, available from DIC Corporation) | 46 parts |
| Anionic surfactant (DOWFAX available from Dow Chemical Company) | 4 parts |
| Ion exchange water | 200 parts |

The above materials are mixed and heated to 96° C. The mixture is dispersed at 3,000 rpm using a homogenizer (Ultra-Turrax T50 available from IKA) for 1 hour and is then dispersed using a pressure discharge homogenizer (available from Gaulin) to yield a colorant dispersion with a volume average particle size of 150 nm and a solid content of 20.0%.

Example 1

Preparation of Toner Particles

| | |
|---|---|
| Amorphous polyester resin particle dispersion (1) | 100 parts |
| Crystalline polyester resin particle dispersion (1) | 40 parts |
| Release agent particle dispersion | 30 parts |
| Colorant particle dispersion | 7 parts |
| Aluminum sulfate | 0.5 part |
| Ion exchange water | 300 parts |

The above materials are charged to a stainless round-bottom flask and are adjusted to pH 3. The mixture is dispersed using a homogenizer (Ultra-Turrax T50 available from IKA) and is then heated to 45° C. in a heating oil bath with stirring. At this time, aggregated particles with an average particle size of 4.8 μm are observed under a light microscope. After the mixture is held at 45° C. for 30 minutes, aggregated particles with an average particle size of 5.2 μm are observed under a light microscope. To the mixture, 60 parts of amorphous polyester resin particle dispersion (1) is added. After the mixture is held for 30 minutes, aggregated particles with an average particle size of 5.8 μm are observed under a light microscope. The pH is then adjusted to 8.5 by gently adding a 1N sodium hydroxide aqueous solution, and the mixture is heated to 80° C. with continued stirring and is held for 3 hours.

After the reaction is complete, the resulting mixture is cooled, is filtered, and is washed with ion exchange water, and the solid is separated by Nutsche suction filtration. The solid is then redispersed in 3 L of ion exchange water at 40° C., is stirred at 300 rpm for 15 minutes, and is washed. This is repeated a further five times. When the pH of the filtrate is 7, the solid is separated using No. 5A filter paper by Nutsche suction filtration. The solid is then dried in a vacuum for 12 hours to yield toner particles (1).

Toner particles (1) have a volume average particle size D50v of 5.81 μm, a volume average geometric size distribution GSDv of 1.20, and a shape factor SF1 of 130.

Preparation of Developer

Coated toner (1) is prepared by mixing 50 parts of toner particles (1) with 1.2 parts of hydrophobic silica (TS720 available from Cabot Corporation) in a sample mill.

A ferrite carrier is also prepared by coating ferrite with poly(methyl methacrylate) (available from Soken Chemical & Engineering Co., Ltd.). The ferrite carrier has a volume average particle size of 50 μm and contains poly(methyl methacrylate) in an amount of 1% by mass of the mass of ferrite.

Coated toner (1) and the ferrite carrier are mixed in a toner concentration of 5% (by mass of the developer). The mixture is stirred in a ball mill for 5 minutes to yield developer (1).

Examples 2 to 17

In Examples 2 to 17, toner particles (2) to (17), coated toners (2) to (17), and developers (2) to (17) are prepared as in Example 1 using the resin particle dispersions shown in Table 3.

Comparative Examples 1 to 5

In Comparative Examples 1 to 5, toner particles (C1) to (C5), coated toners (C1) to (C5), and developers (C1) to (C5) are prepared as in Example 1 using the resin particle dispersions shown in Table 3.

Evaluations

A 10 cm×10 cm solid image is repeatedly formed on A4 size white paper (J-A4 paper available from Fuji Xerox Co., Ltd., width: 210 mm, length: 297 mm) as recording media using an altered DocuCentre Color 500 CP available from Fuji Xerox Co., Ltd. as an image-forming apparatus. The fixing temperature (the preset temperature of the heating belt and the fixing roller) is raised from 110° C. to 200° C. in increments of 5° C.

Image Strength

An image fixed at the lowest fixing temperature (the temperature at which no cold offset occurs) is folded under a load of 1 kg. The line width (crease width) of a white area formed in the fixed image is measured and is rated on the following scale. The results are summarized in Table 3.

A: The crease width is less than 0.4 mm.

B: The crease width is 0.4 to less than 0.6 mm.

C: The crease width is 0.6 to less than 0.8 mm.

D: The crease width is 0.8 mm or more.

Fixability

The temperature $T^1$ (° C.) at which no cold offset occurs and the temperature $T^2$ (° C.) at which a cold offset starts to occur are examined. The difference T ($T^2-T^1$) (° C.) between the temperature $T^1$ and the temperature $T^2$ is calculated and is rated on the following scale. The results are summarized in Table 3.

The lower the temperature $T^1$, the less likely a cold offset is to occur, and the higher the temperature $T^2$, the less likely a hot offset to occur. The higher the value of T, the wider the temperature range where a toner image can be fixed.

A: The temperature difference T is higher than 70° C.

B: The temperature difference T is higher than 60° C. to 70° C.

C: The temperature difference T is higher than 50° C. to 60° C.

D: The temperature difference T is 50° C. or lower.

TABLE 3

| | | Resin particle dispersion | | | | | |
|---|---|---|---|---|---|---|---|
| | | Amorphous polyester resin | | | | Crystalline polyester resin | |
| | Toner particles/coated toner/developer | Type | Weight average molecular weight (Mw) | Molecular weight distribution (Mw/Mn) | Number of carbon atoms in linear side chain | Type | Number of carbon atoms in main chain (dicarboxylic acid/diol) |
| Example 1 | (1) | (1) | 59000 | 6.9 | 1 | (1) | 10/9 |
| Example 2 | (2) | (2) | 62000 | 6.9 | 1 | (1) | 10/9 |
| Example 3 | (3) | (3) | 80000 | 6.7 | 1 | (1) | 10/9 |
| Example 4 | (4) | (4) | 40000 | 6.2 | 1 | (1) | 10/9 |
| Example 5 | (5) | (5) | 55000 | 9.0 | 1 | (1) | 10/9 |
| Example 6 | (6) | (6) | 69000 | 16.0 | 1 | (1) | 10/9 |
| Example 7 | (7) | (7) | 80000 | 19.5 | 1 | (1) | 10/9 |
| Example 8 | (8) | (8) | 73000 | 9.1 | 12 | (1) | 10/9 |
| Example 9 | (9) | (9) | 65000 | 7.4 | 4 | (1) | 10/9 |
| Example 10 | (10) | (10) | 71000 | 7.5 | 16 | (1) | 10/9 |
| Example 11 | (11) | (2) | 62000 | 6.9 | 1 | (2) | 9/10 |
| Example 12 | (12) | (2) | 62000 | 6.9 | 1 | (3) | 10/6 |
| Example 13 | (13) | (2) | 62000 | 6.9 | 1 | (4) | 6/10 |
| Example 14 | (14) | (2) | 62000 | 6.9 | 1 | (5) | 6/6 |
| Example 15 | (15) | (2) | 62000 | 6.9 | 1 | (6) | 8/6 |
| Example 16 | (16) | (2) | 62000 | 6.9 | 1 | (7) | 8/9 |
| Example 17 | (17) | (2) | 62000 | 6.9 | 1 | (8) | 8/10 |
| Comparative Example 1 | (C1) | (C1) | 20000 | 5.0 | 1 | (1) | 10/9 |
| Comparative Example 2 | (C2) | (C2) | 100000 | 11.8 | 1 | (1) | 10/9 |
| Comparative Example 3 | (C3) | (2) | 62000 | 6.9 | 1 | (C1) | 10/10 |
| Comparative Example 4 | (C4) | (2) | 62000 | 6.9 | 1 | (C2) | 10/5 |
| Comparative Example 5 | (C5) | (2) | 62000 | 6.9 | 1 | (C3) | 5/10 |

| | Toner | | | Evaluations | | | |
|---|---|---|---|---|---|---|---|
| | D50v (μ) | GSDv | SF1 | Image strength | Temperature $T^1$ (° C.) | Temperature $T^2$ (° C.) | Temperature range where fixing is possible |
| Example 1 | 5.81 | 1.20 | 130 | B | 120 | 185 | B |
| Example 2 | 5.80 | 1.21 | 132 | B | 120 | 185 | B |
| Example 3 | 5.75 | 1.20 | 131 | B | 125 | 200 | A |
| Example 4 | 5.90 | 1.20 | 129 | B | 110 | 175 | B |
| Example 5 | 5.95 | 1.21 | 130 | B | 120 | 185 | B |
| Example 6 | 6.00 | 1.20 | 128 | A | 125 | 190 | B |
| Example 7 | 5.80 | 1.22 | 129 | A | 120 | 195 | A |
| Example 8 | 5.85 | 1.23 | 128 | A | 115 | 190 | A |
| Example 9 | 5.80 | 1.22 | 130 | A | 110 | 185 | A |
| Example 10 | 5.85 | 1.23 | 131 | A | 115 | 180 | B |
| Example 11 | 5.90 | 1.21 | 130 | B | 120 | 185 | B |
| Example 12 | 5.70 | 1.21 | 130 | B | 120 | 185 | B |
| Example 13 | 5.80 | 1.22 | 131 | B | 120 | 185 | B |
| Example 14 | 5.85 | 1.23 | 130 | B | 115 | 180 | B |
| Example 15 | 5.71 | 1.20 | 132 | A | 115 | 185 | B |
| Example 16 | 5.80 | 1.20 | 129 | A | 120 | 185 | B |
| Example 17 | 5.75 | 1.21 | 129 | B | 120 | 185 | B |
| Comparative Example 1 | 5.92 | 1.21 | 131 | C | 110 | 155 | D |

TABLE 3-continued

| | | | | | | | |
|---|---|---|---|---|---|---|---|
| Comparative Example 2 | 5.80 | 1.20 | 133 | C | 150 | 200 | D |
| Comparative Example 3 | 5.90 | 1.21 | 131 | C | 135 | 185 | D |
| Comparative Example 4 | 5.92 | 1.22 | 129 | D | 120 | 175 | C |
| Comparative Example 5 | 5.83 | 1.21 | 131 | D | 120 | 175 | C |

Table 3 shows that the toners of the Examples provide fixed images with higher image strengths than the toners of the Comparative Examples when fixed at relatively low temperatures.

Table 3 also shows that the toners of the Examples have wider temperature ranges where a toner image can be fixed than the toners of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

an amorphous polyester resin that has repeating units having a backbone derived from dehydroabietic acid in a main chain thereof and that has a weight average molecular weight of about 30,000 to about 80,000; and at least one of a crystalline polyester resin containing a dicarboxylic acid (C10) and a diol (C9) as polymerization components and a crystalline polyester resin containing a dicarboxylic acid (C9) and a diol (C10) as polymerization components, the dicarboxylic acid (C10) being a dicarboxylic acid or a derivative thereof containing a first carbonyl group and a second carbonyl group coupled together by consecutive carbon atoms, wherein the minimum number of consecutive carbon atoms from the carbon atom directly attached to the first carbonyl group to the carbon atom directly attached to the second carbonyl group is 6 to 10, the dicarboxylic acid (C9) being a dicarboxylic acid or a derivative thereof containing a first carbonyl group and a second carbonyl group coupled together by consecutive carbon atoms, wherein the minimum number of consecutive carbon atoms from the carbon atom directly attached to the first carbonyl group to the carbon atom directly attached to the second carbonyl group is 6 to 9, the diol (C10) being a diol containing a first hydroxy group and a second hydroxy group coupled together by consecutive carbon atoms, wherein the minimum number of consecutive carbon atoms from the carbon atom directly attached to the first hydroxy group to the carbon atom directly attached to the second hydroxy group is 6 to 10, and the diol (C9) being a diol containing a first hydroxy group and a second hydroxy group coupled together by consecutive carbon atoms, wherein the minimum number of consecutive carbon atoms from the carbon atom directly attached to the first hydroxy group to the carbon atom directly attached to the second hydroxy group is 6 to 9, wherein the amorphous polyester resin is a polycondensate of a dehydroabietic acid derivative and other polycarboxylic acids with a diol, and the proportion of the dehydroabietic acid derivative in all carboxylic acids is 5 to 20 mol %, and wherein the dehydroabietic acid derivative is at least one selected from the group consisting of compounds represented by the following formulae DHA (1) and DHA (2):

DHA (1)

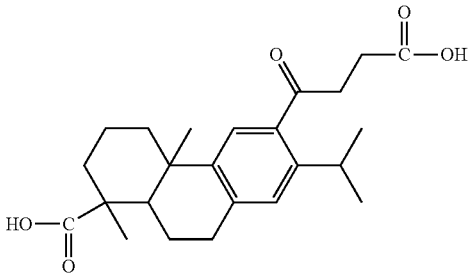

DHA (2)

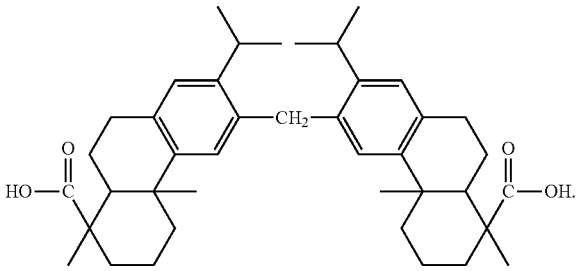

2. The electrostatic-image developing toner according to claim 1, wherein the amorphous polyester resin has a linear hydrocarbon group having about 4 to about 14 carbon atoms as a side chain thereof.

3. The electrostatic-image developing toner according to claim 1, wherein the crystalline polyester resin has a weight average molecular weight of about 1,000 to about 30,000.

4. The electrostatic-image developing toner according to claim 1, wherein the amorphous polyester resin has a crosslinked portion.

5. The electrostatic-image developing toner according to claim 1, wherein the amorphous polyester resin has a weight average molecular weight of about 45,000 to about 70,000.

6. The electrostatic-image developing toner according to claim 1, wherein the dicarboxylic acid (C9) is at least one compound selected from the group consisting of suberic acid, azelaic acid, sebacic acid, n-undecanedioic acid, and lower alkyl esters thereof.

7. The electrostatic-image developing toner according to claim 1, wherein the dicarboxylic acid (C10) is at least one compound selected from the group consisting of suberic acid, azelaic acid, sebacic acid, n-undecanedioic acid, n-dodecanedioic acid, and lower alkyl esters thereof.

8. The electrostatic-image developing toner according to claim 1, wherein the diol (C9) is at least one compound selected from the group consisting of 1,6-hexanediol, 1,7-heptanediol, 1,8-octanediol, and 1,9-nonanediol.

9. The electrostatic-image developing toner according to claim 1, wherein the diol (C10) is at least one compound selected from the group consisting of 1,6-hexanediol, 1,7-heptanediol, 1,8-octanediol, 1,9-nonanediol, and 1,10-decanediol.

10. The electrostatic-image developing toner according to claim 1, wherein the electrostatic-image developing toner has a volume average particle size D50v of about 2 to about 8 μm.

11. The electrostatic-image developing toner according to claim 1, wherein the electrostatic-image developing toner has a volume average geometric size distribution GSDv of about 1.0 to about 1.3.

12. The electrostatic-image developing toner according to claim 1, wherein the electrostatic-image developing toner has a shape factor SF1 of about 110 to about 140.

13. An electrostatic image developer comprising the electrostatic-image developing toner according to claim 1.

14. A toner cartridge attachable to and detachable from an image-forming apparatus, the toner cartridge containing the electrostatic-image developing toner according to claim 1.

15. A process cartridge attachable to and detachable from an image-forming apparatus, the process cartridge comprising a developing unit that contains the electrostatic image developer according to claim 13 and that develops an electrostatic image formed on a surface of an image carrier with the electrostatic image developer to form a toner image.

16. An image-forming apparatus comprising:

an image carrier having a surface;

a charging unit that charges the surface of the image carrier;

an electrostatic-image forming unit that forms an electrostatic image on the charged surface of the image carrier;

a developing unit that contains the electrostatic image developer according to claim 13 and that develops the electrostatic image formed on the surface of the image carrier with the electrostatic image developer to form a toner image;

a transfer unit that transfers the toner image to a recording medium; and a fixing unit that fixes the toner image to the recording medium.

17. A method for forming an image, comprising:

charging a surface of an image carrier;

forming an electrostatic image on the charged surface of the image carrier;

developing the electrostatic image formed on the surface of the image carrier with the electrostatic image developer according to claim 13 to form a toner image;

transferring the toner image to a recording medium; and fixing the toner image to the recording medium.

18. The electrostatic-image developing toner according to claim 1, wherein the other polycarboxylic acids are selected from the group consisting of terephthalic acid, dodecenylsuccinic acid, butenylsuccinic acid and hexadecylsuccinic acid.

* * * * *